US011203496B2

(12) United States Patent
Tsuda et al.

(10) Patent No.: US 11,203,496 B2
(45) Date of Patent: Dec. 21, 2021

(54) IMAGE FORMING APPARATUS

(71) Applicant: CANON KABUSHIKI KAISHA, Tokyo (JP)

(72) Inventors: Satoshi Tsuda, Mishima (JP); Yasuhiko Fuse, Mishima (JP); Takashi Kuwata, Suntou-gun (JP); Yoshiteru Kaida, Numazu (JP); Shoichi Koyama, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 176 days.

(21) Appl. No.: 16/429,650

(22) Filed: Jun. 3, 2019

(65) Prior Publication Data

US 2019/0375605 A1 Dec. 12, 2019

(30) Foreign Application Priority Data

Jun. 8, 2018 (JP) ..... JP2018-110039

(51) Int. Cl.

| | |
|---|---|
| ***B65H 3/06*** | (2006.01) |
| ***B65H 7/06*** | (2006.01) |
| ***B65H 5/06*** | (2006.01) |
| ***B65H 1/26*** | (2006.01) |
| ***G03G 21/16*** | (2006.01) |
| ***G03G 15/00*** | (2006.01) |

(52) U.S. Cl.

CPC ..... *B65H 3/06* (2013.01); *B65H 1/266* (2013.01); *B65H 5/062* (2013.01); *B65H 7/06* (2013.01); *G03G 15/6511* (2013.01); *G03G 21/1695* (2013.01); *B65H 2404/10* (2013.01); *B65H 2513/52* (2013.01); *B65H 2513/53* (2013.01)

(58) Field of Classification Search

CPC . B65H 3/06; B65H 7/06; B65H 5/062; B65H 1/266; B65H 2513/52; B65H 2513/53; B65H 2513/106; B65H 2513/511; B65H 2513/50; B65H 2404/10; B65H 7/02; B65H 7/18

See application file for complete search history.

(56) References Cited

U.S. PATENT DOCUMENTS

| | | | | |
|---|---|---|---|---|
| 5,667,215 | A * | 9/1997 | Yoshino | B65H 43/00 271/110 |
| 6,988,727 | B2 * | 1/2006 | Yano | B65H 5/06 271/264 |
| 7,539,599 | B2 * | 5/2009 | Hasegawa | G03G 15/55 700/10 |
| 9,488,948 | B2 * | 11/2016 | Kitamura | G03G 15/55 |
| 9,624,058 | B2 * | 4/2017 | Inoue | B65H 7/14 |

(Continued)

FOREIGN PATENT DOCUMENTS

| | | | |
|---|---|---|---|
| JP | 2007-050940 | A | 3/2007 |
| JP | 2007-256369 | A | 10/2007 |
| JP | 2017-007758 | A | 1/2017 |

*Primary Examiner* — Luis A Gonzalez

(74) *Attorney, Agent, or Firm* — Venable LLP

(57) ABSTRACT

An image forming apparatus includes a feeding unit, a detection unit provided downstream of the feeding unit, a measurement unit that measures a measured time from the start of conveyance of a recording material to the detection of the recording material, and a determination unit that performs renewal determination for determining whether the feeding unit has been replaced with a new feeding unit. Thus, replacement of the feeding unit with a new feeding unit can automatically be detected.

12 Claims, 15 Drawing Sheets

(56) References Cited

U.S. PATENT DOCUMENTS

2005/0281596 A1* 12/2005 Nakagawa ..... G03G 15/5054
399/350
2009/0317096 A1* 12/2009 Odaira ..... G03G 15/6529
399/21

* cited by examiner

IMAGE FORMING APPARATUS

BACKGROUND OF THE INVENTION

Field of the Invention

The present invention relates to an image forming apparatus, and in particular to an image forming apparatus that controls feeding of a recording material by a feeding device used in, e.g., a copier or printer.

Description of the Related Art

Conventionally, an image forming apparatus such as a copier or printer has included a sheet feeding mechanism by which sheets of recording material stacked in a sheet feeding unit are separately fed one by one. The sheet feeding mechanism is typically configured as sheet feeding rollers that feed sheets one by one. The conveyance performance of the sheet feeding rollers is reduced by surface abrasion or deterioration, or adhesion of paper particles, caused by repetitive sheet feeding. Therefore, the sheet feeding rollers are regarded as supplies and replaced by a user or a serviceperson. Various detection methods have been proposed for the main body of the image forming apparatus to detect the appropriate time to replace the sheet feeding rollers.

For example, in Japanese Patent Application Laid-Open No. 2017-007758, a sheet delay is detected by measuring the time from the start of roller rotation to the arrival of a sheet at a sensor provided downstream in the conveyance path. If the incidence of sheet delays exceeds a threshold, a notification of the need to replace the rollers is provided. In Japanese Patent Application Laid-Open No. 2017-007758, if an image forming apparatus determines that the sheet feeding rollers should be replaced, the apparatus prompts a user or serviceperson to replace the sheet feeding rollers in order to prevent future conveyance failures that may cause, e.g., printing failures. After the sheet feeding rollers are replaced with new ones, the user or serviceperson operates the image forming apparatus to reset the use state of the sheet feeding rollers. This operation allows the use state of the inserted new rollers to be correctly recognized still after the replacement.

However, this operation relies on the operator such as the user or serviceperson, and the operator may forget to perform the operation of resetting the use state of the rollers or verification of the roller operation after replacing the rollers with new ones. Then, with the use state of the inserted new sheet feeding rollers being not reset, the rollers still appear to be in need of replacement although the rollers have actually been inserted as a replacement.

Further, for an image forming apparatus having multiple sheet feeding inlets, the operator may erroneously reset the use state of sheet feeding rollers corresponding to a sheet feeding inlet different from the inlet having the rollers replaced. This results in failing to correctly recognize the use state of the sheet feeding rollers actually inserted as a replacement. In view of the above, it is desired to automatically detect replacement of a component with a new component.

SUMMARY OF THE INVENTION

An aspect of the present invention, which was made under the above circumstances, is an image forming apparatus that automatically detects replacement of a component with a new component.

Another aspect of the present invention is an image forming apparatus including a feeding unit configured to convey a recording material and detachably mountable on an apparatus main body that forms an image on the recording material, a first detection unit configured to detect the recording material, the first detection unit provided downstream of the feeding unit in a conveyance direction of the recording material, a measurement unit configured to measure a measured time from start of conveyance of the recording material by the feeding unit to detection of the recording material by the detection unit, and a first determination unit configured to form a first data set from a plurality of measured times acquired by the measurement unit in a plurality of measurement processes, form a second data set from a plurality of measured times acquired by the measurement unit in a plurality of measurement processes during a period different from a period during which the first data set is formed, and perform renewal determination for determining whether the feeding unit is replaced with a new unit based on a change from the first data set to the second data set.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

As an exemplary image forming apparatus, an electrophotographic color laser printer (hereinafter referred to as a printer) will be described herein with reference to the drawings. Although the present invention is applied herein to a printer as the image forming apparatus, the present invention is not limited to this but may also be applied to apparatuses such as a copier and an ink-jet printer.

<Printer Configuration and Image Forming Operations>

Figure 1:
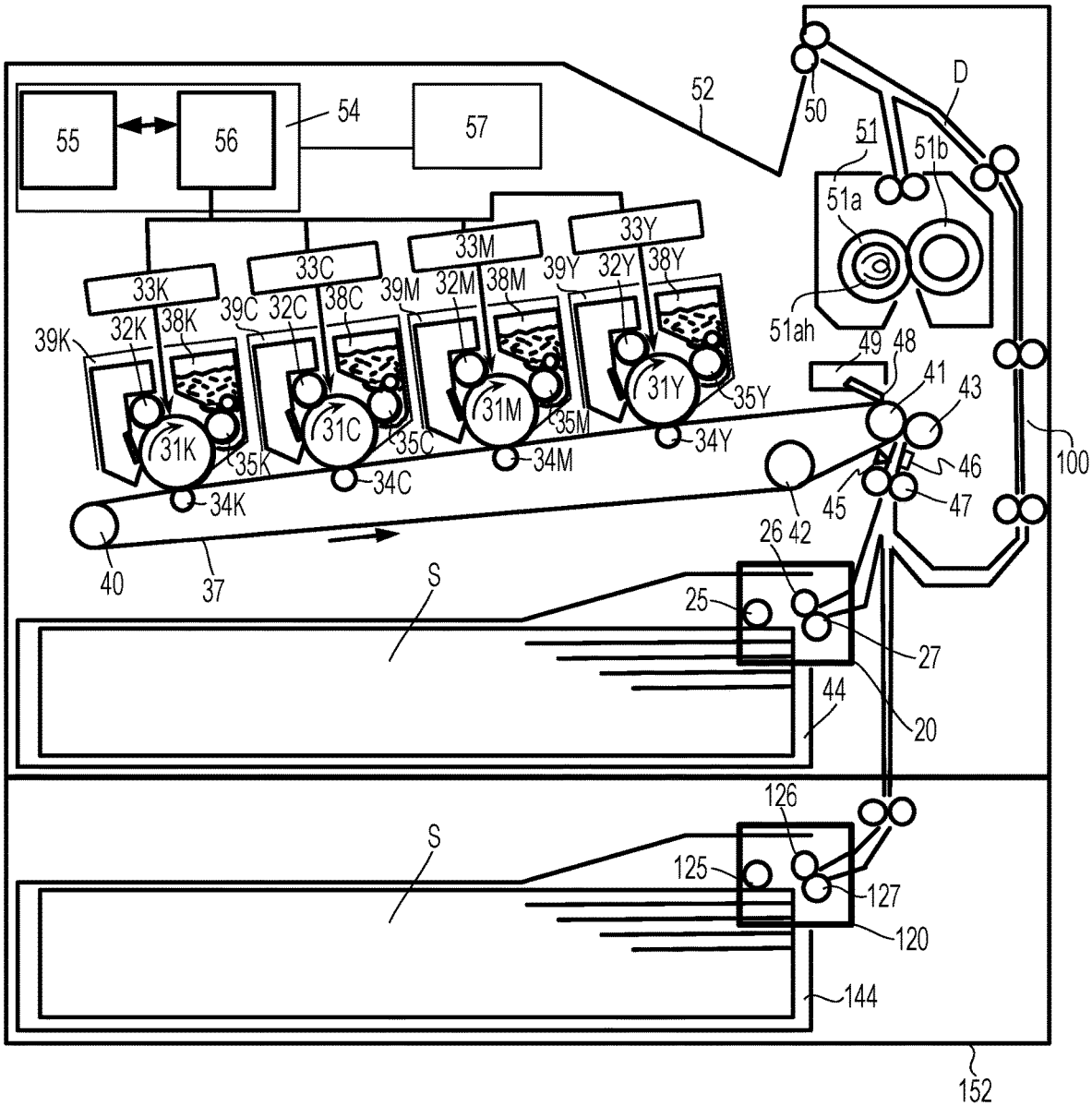
FIG. 1 is a schematic cross-sectional view of a printer in first to fifth embodiments.

A general configuration of a printer 100 will be described with reference to FIG. 1. FIG. 1 illustrates a schematic cross-sectional structure of the printer 100 in a first embodiment. First, image forming units will be described. The printer 100 includes image forming units for the respective stations of the colors cyan (C), magenta (M), yellow (Y) and black (B). The image forming units include respective photosensitive drums 31Y, 31M, 31C and 31K. Because each image forming unit has the same configuration except for the color, the indexes Y, M, C and K of reference numerals will hereinafter be omitted except in the cases where a specific color is referred to. The image forming unit includes a charge roller 32 as a charging unit, an exposure scanner unit 33, and a development device 38 as a development unit. The printer 100 includes an intermediate transfer belt 37, a driving roller 41 that drives the intermediate transfer belt 37, a tension roller 40, and an auxiliary roller 42. The printer 100 also includes primary transfer rollers 34, a secondary transfer roller 43, and a fixation unit 51. The printer 100 includes a control unit 54 for controlling these components. The control unit 54 includes a main body control unit 55 and an imaging control unit 56, which communicate with each other to realize printing operations. The photosensitive drum 31 is formed as an aluminum cylinder with an organic photoconductive layer applied on the outer surface thereof, and is rotated by a driving force transmitted from a driving motor (not illustrated). The driving motor rotates the photosensitive drum 31 clockwise (in the direction of an arrow in FIG. 1) according to image forming operations.

Now, the printing operations in the main body of the printer 100 will be described. The printer 100 includes a sheet feeding cassette 44, which is a storage unit for storing a recording material S and removable from and insertable into the apparatus main body. When the main body control unit 55 receives an image signal, the recording material S is fed from the sheet feeding cassette 44 via a sheet feeding roller group 20, which includes a sheet feeding roller 25, a feeding roller 26 and a separation roller 27, serving as conveyance units. The sheet feeding roller 25, the feeding roller 26 and the separation roller 27 have respective claw portions 25*a*, 26*a* and 27*a* (see FIG. 2). The sheet feeding roller group 20, which is a feeding unit, is detachably mountable on the printer 100. The sheet feeding roller group 20 is mounted on the printer 100 by engaging the claw portions 25*a*, 26*a* and 27*a*, and is made detachable from the printer 100 by disengaging the claw portions 25*a*, 26*a* and 27*a*.

If a user designates printing on a sheet stored in an optional sheet feeding cassette 152, the recording material S is fed from a sheet feeding cassette 144, which is a storage unit, via a sheet feeding roller group 120 including a sheet feeding roller 125, a feeding roller 126 and a separation roller 127. A registration sensor 45 as the first detection unit is provided downstream of the sheet feeding roller groups 20 and 120 in the conveyance direction. The registration sensor 45 detects the leading edge of the recording material S fed via the sheet feeding roller group 20 or 120. The recording material S then temporarily stops and waits while being held between a pair of registration rollers 47, which are roller-type synchronous rotary members for synchronizing image forming operations to be described below with the conveyance of the recording material S. At this point, the type of the recording material S is determined by a media sensor 46 as the second detection unit. The main body control unit 55 controls the rotation timing and the rotation speed of the registration roller pair 47 for synchronizing the image forming operations with the conveyance of the recording material S, based on the timing of arrival of the recording material S at the registration sensor 45.

Meanwhile, according to the received image signal, the imaging control unit 56 causes the exposure scanner unit 33 to form an electrostatic latent image on the surface of the photosensitive drum 31 charged at a certain potential by the function of the charge roller 32. The development device 38 is a unit for visualizing the electrostatic latent image and develops an image of yellow (Y), magenta (M), cyan (C) or black (K) in the corresponding station. The development device 38 is provided with a sleeve 35, to which a development voltage for visualizing the electrostatic latent image is applied. Thus, the electrostatic latent image formed on the surface of the photosensitive drum 31 is developed as a single-color toner image by the function of the development device 38. The photosensitive drum 31, the charge roller 32 and the development device 38 are integrally formed and mounted in the form of a toner cartridge 39, which is detachably mountable on the main body of the printer 100.

The intermediate transfer belt 37 is in contact with each photosensitive drum 31 and rotates counterclockwise in synchronization with the rotation of the photosensitive drum 31 during color image forming. Each developed single-color toner image is sequentially transferred onto the intermediate transfer belt 37 in layers by the function of a primary transfer voltage applied to each primary transfer roller 34, forming a multicolor toner image on the intermediate transfer belt 37. The multicolor toner image formed on the intermediate transfer belt 37 is then conveyed to a secondary transfer nip unit formed of the driving roller 41 and the secondary transfer roller 43. The recording material S waiting while being held between the registration roller pair 47 is conveyed by the function of the registration roller pair 47 to the secondary transfer nip unit in synchronization with the multicolor toner image on the intermediate transfer belt 37. The multicolor toner image on the intermediate transfer belt 37 is transferred, by the function of a secondary transfer voltage applied to the secondary transfer roller 43, collectively onto the recording material S conveyed to the secondary transfer nip unit.

The fixation unit 51 fuses and fixes the unfixed transferred multicolor toner image while conveying the recording material S. The fixation unit 51 includes a fixation roller 51*a* for heating the recording material S and a pressurization roller 51*b* for bringing the recording material S into pressure-contact with the fixation roller 51*a*. The fixation roller 51*a* and the pressurization roller 51*b* are formed in hollow shape, and a heater 51*ah* resides inside the fixation roller 51*a*. The recording material S with the unfixed multicolor toner image is conveyed by the fixation roller 51*a* and the pressurization roller 51*b* and subjected to heat and pressure, thereby having the toner fixed onto the surface of the recording material S. The recording material S with the fixed toner image is ejected by an ejection roller 50 onto an ejection tray 52, and the image forming operations terminates. If an image is to be formed on the opposite side of the recording material S as well, the recording material S is conveyed through a double-sided printing conveyance path D by a switchback operation at the ejection unit. Again, the recording material S temporarily stops and waits while being held between the registration roller pair 47. The above-described series of image forming operations is then performed to form an image on the opposite side of the recording material S.

A cleaning unit 48 cleans toner remaining on the intermediate transfer belt 37 after the transfer onto the recording material S. The collected toner is accumulated in a cleaner container 49. The printer 100 also includes an operation panel 57, which is a display unit and an operation unit. The main body control unit 55 displays various sorts of information on the operation panel 57 to an operator such as a user or serviceperson. The operation panel 57 is also used by the operator such as the user or serviceperson to enter various sorts of information.

<Sheet Feeding Unit>

Figure 2:
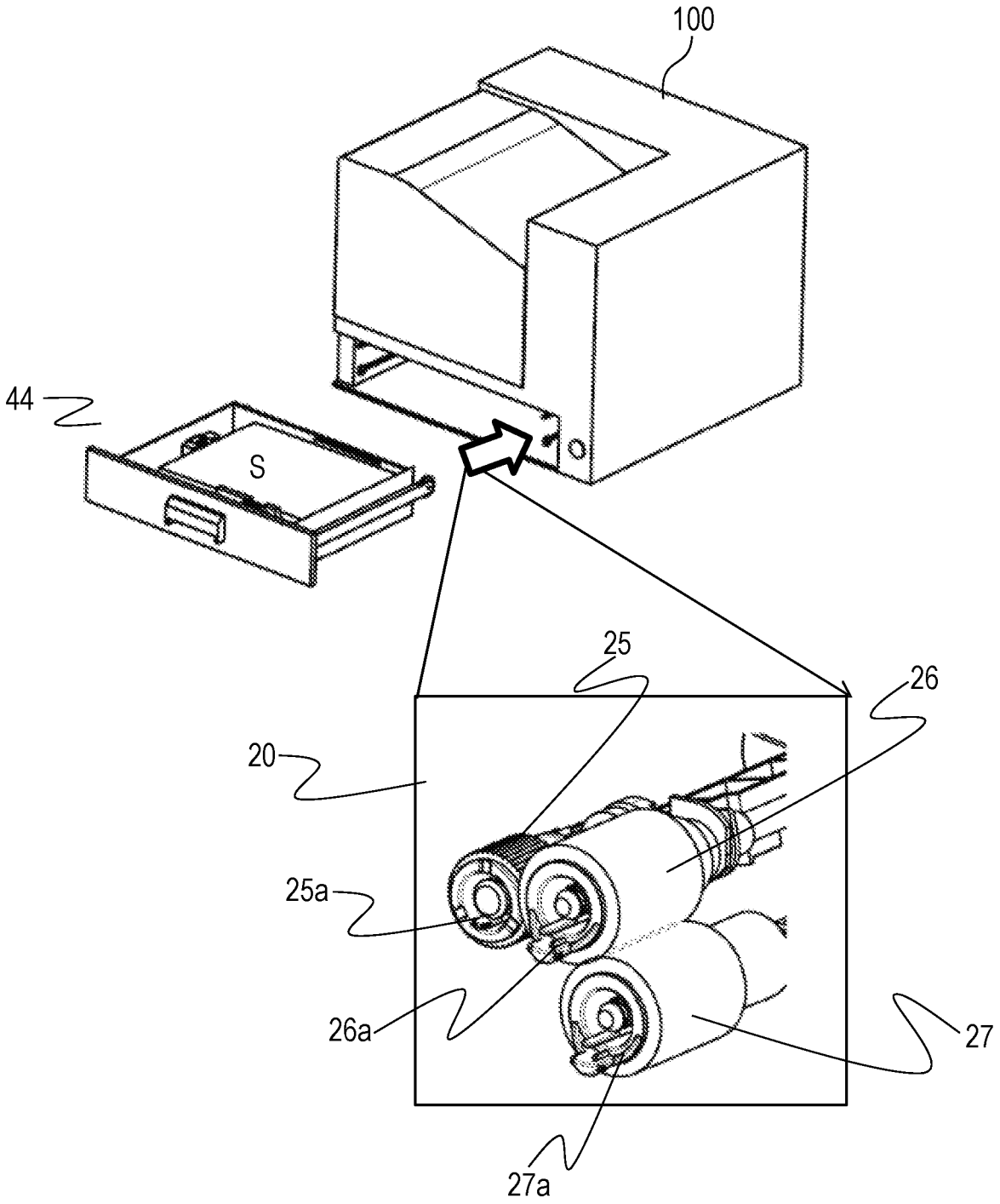
FIG. 2 is a schematic diagram illustrating a configuration of a sheet feeding cassette and a sheet feeding roller group in the first to fifth embodiments.

A configuration of the sheet feeding unit in the first embodiment will be described with reference to FIG. 2. FIG. 2 is a schematic diagram illustrating the sheet feeding cassette 44 removed from the printer 100, and a configuration of the sheet feeding roller group 20. As illustrated in FIG. 2, the sheet feeding cassette 44 is removable (detachable) from the printer 100; when the recording material S runs out, the user draws out the sheet feeding cassette 44 to refill the recording material S. The printer 100 is provided with a cassette open/close sensor 80 (see FIGS. 3A and 3B) as a detection device detecting opening/closing (removal/insertion) of the sheet feeding cassette 44. The cassette open/close sensor 80 continuously monitors opening/closing of the sheet feeding cassette 44. It is to be noted that the state in which the sheet feeding cassette 44 is removed from the printer 100 will be referred to as the open state, and the state in which the sheet feeding cassette 44 is inserted into the printer 100 will be referred to as the closed state.

Drawing out the sheet feeding cassette 44 as in FIG. 2 enables access to the sheet feeding roller group 20. The conveyance performance of the sheet feeding roller group 20 is reduced by surface abrasion or deterioration, or adhesion of paper particles, caused by repetitive feeding of the recording material S. Therefore, the sheet feeding roller group 20 with reduced conveyance performance is replaceable with a new sheet feeding roller group 20. When the conveyance performance of the sheet feeding roller group 20 is reduced, a notification of the reduced conveyance performance needs to be provided to the operator such as the user or serviceperson (hereinafter referred to as the operator) for prompting replacement of the sheet feeding roller group 20. The operator draws out the entire sheet feeding cassette 44 from the printer 100 as in FIG. 2 and disengages the claw portions 25*a*, 26*a* and 27*a* of the respective sheet feeding roller 25, feeding roller 26 and separation roller 27 to replace the sheet feeding roller group 20. The functions and operations of these rollers in sheet feeding will be described in detail below.

FIG. 2 does not illustrate the sheet feeding roller group 120 of the optional sheet feeding cassette 152. However, the sheet feeding roller group 120 is also replaced in the same manner as the replacement through the sheet feeding inlet on the main body of the printer 100 (i.e., the replacement of the sheet feeding roller group 20). The operator draws out the entire sheet feeding cassette 144 and disengages the claw portions of the respective sheet feeding roller 125, feeding roller 126 and separation roller 127 to replace the sheet feeding roller group 120. The optional sheet feeding cassette 152 is also provided with a cassette open/close sensor (not illustrated) that detects opening/closing of the sheet feeding cassette 144.

<Control Unit>

Figure 3A:
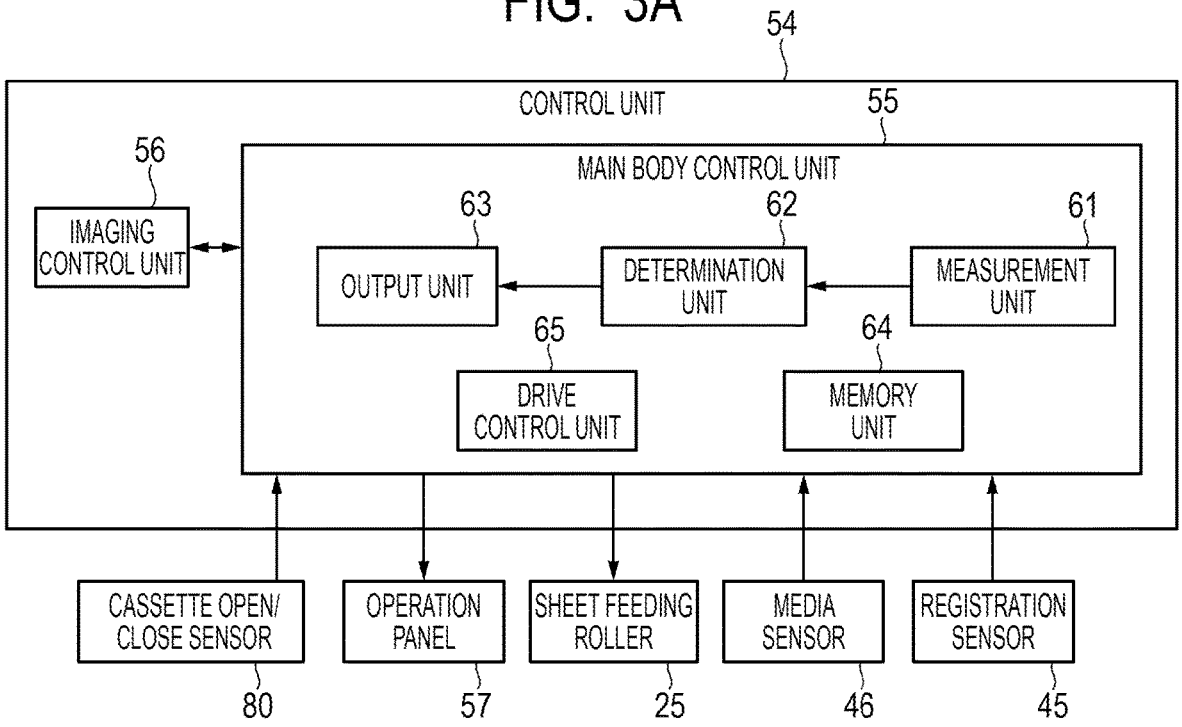
FIGS. 3A and 3B are control block diagrams of the printer and a sheet feeding unit in the first to fifth embodiments.
Figure 3B:
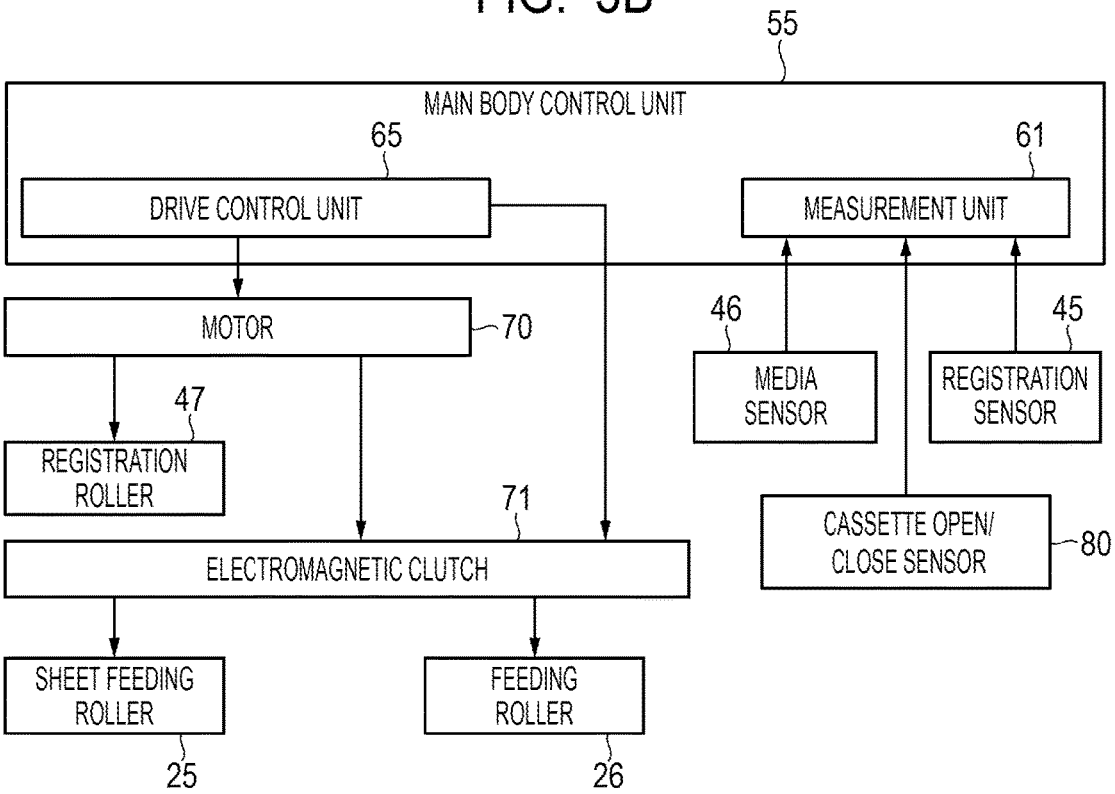

Now, the control unit 54 will be described in detail with reference to FIGS. 3A and 3B. FIG. 3A is a control block diagram of the printer 100 in the first embodiment. FIG. 3B is a block diagram illustrating a control configuration of the sheet feeding unit in the first embodiment. The control unit 54 includes the main body control unit 55 and the imaging control unit 56, which communicate with each other to realize the above-described printing operations. For example, when a print instruction is provided from an external apparatus (not illustrated) such as a personal computer, the imaging control unit 56 analyzes image data and the main body control unit 55 controls components of the printer 100 according to the result of the analysis. The main body control unit 55 has a measurement unit 61, a determination unit 62, an output unit 63, a memory unit 64 and a drive control unit 65. The measurement unit 61 has a timer (not illustrated), for example. The measurement unit 61 measures the elapsed time T from the start of feeding the recording material S by the sheet feeding roller 25 to the arrival of the leading edge of the recording material S at the registration sensor 45, i.e., to the detection of the recording material S by the registration sensor 45. The measured elapsed time T is output to the determination unit 62. The elapsed time T will hereinafter be referred to as the travel time to the registration sensor T. Information about the recording material S detected by the media sensor 46 is also output to the determination unit 62. The media sensor 46 includes a detection mechanism that senses information about the recording material S, such as the basis weight and a surface property of the recording material S, and the determination unit 62 determines the type of the recording material S based on the result of the detection by the media sensor 46. The information about the recording material S is not limited to the above-mentioned basis weight and surface property but may be any information that allows the type of the recording material S to be determined.

Based on the values of the travel time to the registration sensor T input from the measurement unit 61 and on the type of the recording material S, the determination unit 62 determines the use state of the sheet feeding roller group 20 and detects whether the sheet feeding roller group 20 is new (hereinafter referred to as renewal detection). When the sheet feeding roller group 20 cannot maintain a predetermined level of conveyance performance as a result of continual use after replacement, this is referred to as the end of life of the sheet feeding roller group 20. When the sheet feeding roller group 20 is near the end of its life, this is referred to as the late period of its life. Further, the determination as to whether the sheet feeding roller group 20 reaches the end of its life is hereinafter referred as end-of-life determination, which is the determination of the use state of the sheet feeding roller group 20. Details of the end-of-life determination and the renewal detection will be described below.

The determination unit 62 outputs the result of the end-of-life determination and the result of the renewal detection to the output unit 63. The output unit 63 notifies the user, via an operation panel 57 or an external apparatus, of information about the life of the sheet feeding roller group 20 output from the determination unit 62. The memory unit 64 stores information about print requests provided by the imaging control unit 56, information about time values previously measured by the measurement unit 61, and information about previously printed recording material S determined by the determination unit 62. The memory unit 64 further stores the history of sheet feeding inlets for which the life information of the sheet feeding roller group 20 was reset by the operator on the operation panel 57. The drive control unit 65 controls activation and deactivation of the sheet feeding mechanism according to the results of detection by the sensors (to be described below).

The registration sensor 45, the media sensor 46 and the cassette open/close sensor 80 are connected to the main body control unit 55. The drive control unit 65 uses the results of detection by these sensors to control driving of the sheet feeding roller 25 and the registration roller pair 47. Further, the operation panel 57 to which the output unit 63 outputs information is connected to the main body control unit 55.

<Main Body Control Unit>

Now, control of the sheet feeding unit by the main body control unit 55 will be described. In FIG. 3B, a motor 70 is a driving source that drives the sheet feeding roller 25, the feeding roller 26 and the registration roller pair 47. An electromagnetic clutch 71 transmits and stops a driving force from the motor 70 to the sheet feeding roller 25 and the feeding roller 26. The drive control unit 65 can turn on and off the driving of each component by controlling the motor 70 and the electromagnetic clutch 71. The cassette open/close sensor 80 is connected to the measurement unit 61, so that the sheet feeding operation is not started unless the sheet feeding cassette 44 is inserted in the printer 100. That is, the electromagnetic clutch 71 is controlled not to be turned on unless the cassette open/close sensor 80 detects the closed state of the sheet feeding cassette 44.

<Sheet Feeding Control>

Figure 4A:
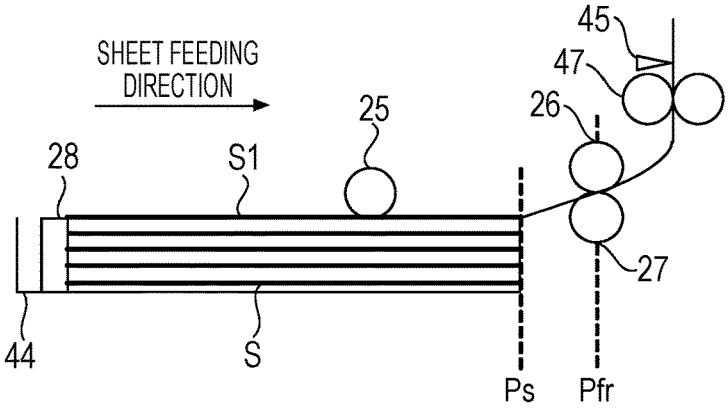
FIGS. 4A, 4B, 4C and 4D are schematic cross-sectional views illustrating a sheet feeding operation in the first to fifth embodiments.
Figure 4B:
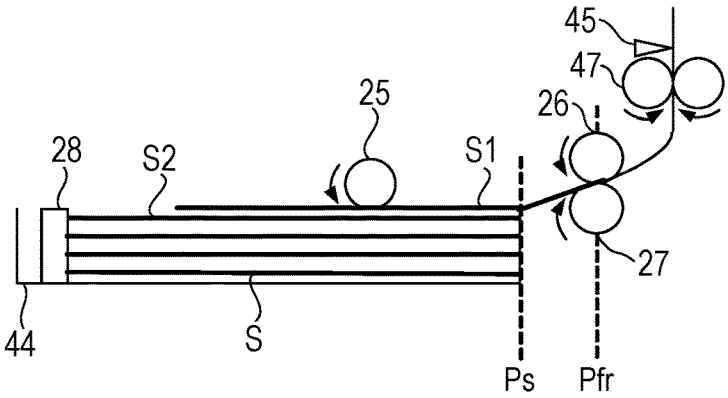

Now, sheet feeding control in the printer 100 in the first embodiment will be described in detail with reference to FIGS. 4A to 4D. FIGS. 4A to 4D are schematic cross-sectional views illustrating the sheet feeding operation in the printer 100 in the first embodiment. FIG. 4A is a diagram illustrating the timing of feeding a sheet of recording material 51 located on top of the sheets of recording material S stored in the sheet feeding cassette 44. The sheet of recording material 51 is followed by a sheet of recording material S2. The sheet of recording material 51 in the sheet feeding cassette 44 is positioned by a trailing-edge regulation plate 28 in the sheet feeding cassette 44, and the leading edge of the sheet of recording material 51 about to be fed is located at Ps in FIG. 4A. When the sheet feeding control is started, the sheet feeding roller 25 and the feeding roller 26 rotate to feed the sheet of recording material 51 in the rightward direction in FIG. 4A (hereinafter referred to as the sheet feeding direction). Here, the start of the sheet feeding control is the point at which the electromagnetic clutch 71 is turned on after the drive control unit 65 rotates the motor 70. Once the electromagnetic clutch 71 is turned on, a driving force of the motor 70 is transmitted to the sheet feeding roller 25 and the feeding roller 26 (see FIG. 3B). As the sheet feeding roller 25 starts rotating, the sheet of recording material 51 starts moving in the sheet feeding direction in FIG. 4A due to friction between the sheet feeding roller 25 and the sheet of recording material 51. The leading edge of the sheet of recording material 51 then reaches a separation nip unit Pfr formed of the feeding roller 26 and the separation roller 27 (FIG. 4B). This separation nip unit Pfr has the function of separating two or more sheets of recording material S conveyed by the sheet feeding roller 25 to the separation nip unit, and conveying only one of the sheets of recording material S downstream in the sheet feeding direction. A torque limiter (not illustrated) is connected to the separation roller 27, so that a torque is applied as a resisting force in the direction opposite to the conveyance direction of the sheet of recording material S1. This torque causes the separation roller 27 to rotate along with the feeding roller 26 if only one sheet of recording material S enters the separation nip unit Pfr, and to stop if two sheets of recording material S enter the separation nip unit Pfr. This allows the separation nip unit Pfr to convey the sheets of recording material S one by one downstream in the sheet feeding direction.

Figure 4C:
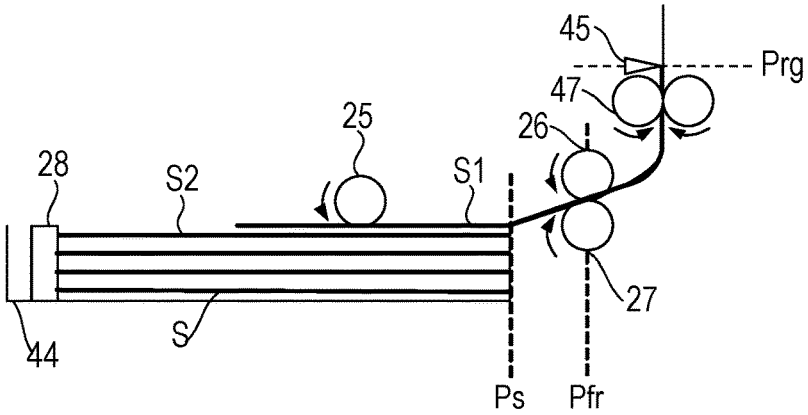
Figure 4D:
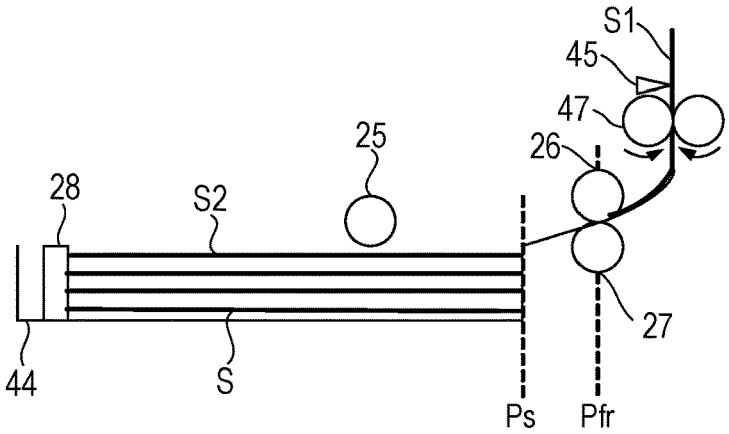

As the sheet feeding roller 25 and the feeding roller 26 further continue rotating, the sheet of recording material S1 passes between the registration roller pair 47, and the leading edge of the sheet of recording material S1 reaches a position Prg, where the leading edge is detected by the registration sensor 45 (FIG. 4C). Once the sheet of recording material S1 reaches the registration sensor 45, the rotation of the motor 70 is stopped to halt the conveyance of the sheet of recording material S1 for synchronization with the image forming operations, as described above. The image forming operations are then performed as described above and the image is printed on the sheet (FIG. 4D). This period from the start of the sheet feeding control to the arrival of the leading edge of the sheet of recording material S1 at the registration sensor 45 is the travel time to the registration sensor T.

<Elapsed Time to Reach Registration Sensor T>

Figure 5A:
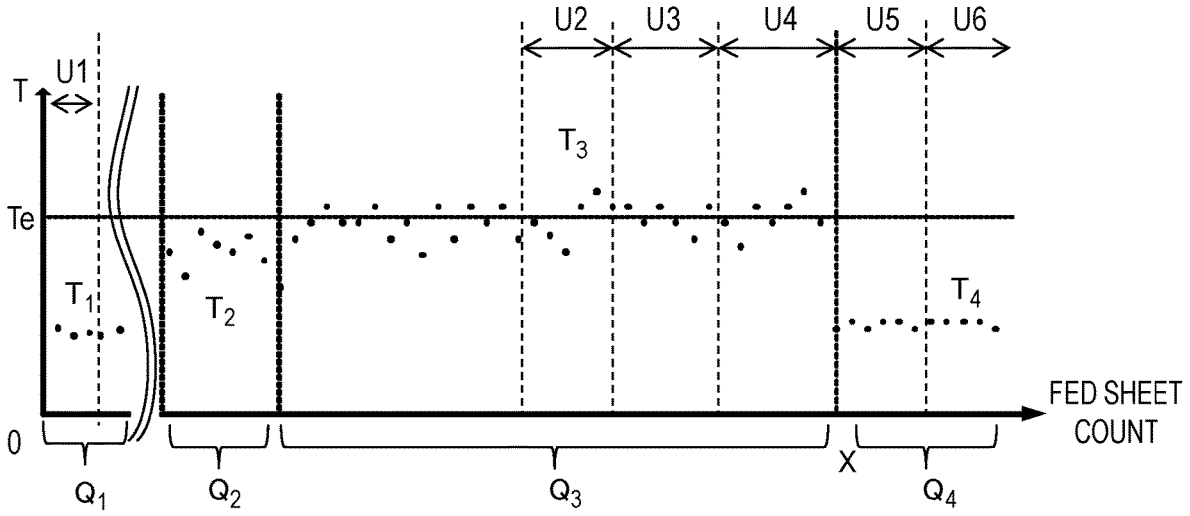
FIGS. 5A and 5B are graphs illustrating variations in the elapsed time and shifts in the average elapsed time in the first embodiment.

Here, the characteristics of the travel time to the registration sensor T will be described with reference to FIG. 5A. FIG. 5A is a graph illustrating variations in the travel time to the registration sensor T depending on conditions. In FIG. 5A, the abscissa indicates the number of sheets of recording material S fed by the sheet feeding roller group 20 (hereinafter referred to as the fed sheet count), and the ordinate indicates the travel time to the registration sensor T. Each of the intervals Q1 to Q4 on the abscissa is under a different set of conditions. As described above, the travel time to the registration sensor T is the time from the start of the sheet feeding control to the arrival of the leading edge of the recording material S1 at the registration sensor 45. The travel time to the registration sensor T varies with the surface conditions of components such as the sheet feeding roller 25 and the feeding roller 26, the type of the recording material S, and the environment. The travel time to the registration sensor T varies even under the same conditions (for example, varies within the interval Q1).

Q1 in FIG. 5A illustrates the distribution of elapsed times to reach the registration sensor T1 resulting from printing on plain paper with a new sheet feeding roller group 20. Q2 illustrates the distribution of elapsed times to reach the registration sensor T2 resulting from printing with the new sheet feeding roller group 20 as in Q1, but on cardboard paper. The distribution tends to have the relationship T2>T1, indicating that the cardboard paper requires a longer time to reach the registration sensor 45 due to higher conveyance resistance of the cardboard paper than that of the plain paper. Q3 illustrates the distribution of elapsed times to reach the registration sensor T3 resulting from printing on the plain paper with the sheet feeding roller group 20 in the late period of its life, and the distribution has the relationship T3>T1. This is because the conveyance performance is reduced by surface abrasion or deterioration, or adhesion of paper particles, caused by repetitive feeding of the recording material S. Q4 illustrates the distribution of elapsed times to reach the registration sensor T4 immediately after replacing the sheet feeding roller group 20 with a new one in the state of Q3. The sheet feeding roller group 20 is replaced at the point X in FIG. 5A. It can be seen that, after the point X, the elapsed times to reach the registration sensor T4 in Q4 have the relationship T4≈T1<T3 and also has a narrower range of variations. This is because the sheet feeding roller group 20 is replaced with the new one and the conveyance performance is recovered to a state similar to the state in Q1.

<End-of-Life Detection and Roller Replacement>

As described above, the travel time to the registration sensor T varies widely with the type of the recording material S and the life state of the sheet feeding roller group 20. However, as illustrated in FIG. 5A, under the same condition (for example, plain paper), the travel time to the registration sensor T shifts with varying values, and the amount and the variation of the travel time to the registration sensor T gradually increase with the increase of the fed sheet count. When the sheet feeding roller group 20 enters the late period of its life, the sheet feeding roller group 20 enters the state as in Q3 in FIG. 5A. In the first embodiment, the characteristics found in FIG. 5A are utilized to determine the end of life of the sheet feeding roller group 20. Specifically, a life threshold value Te is set as illustrated in FIG. 5A to determine that the end of life is reached when the average travel time to the registration sensor T in an interval exceeds the life threshold value Te. At this point, the determination unit 62 in FIG. 3A which also functions as a second determination unit determines the end of life of the sheet feeding roller group 20 and outputs the result of the determination to the output unit 63. The output unit 63 provides a notification of the end of life of the sheet feeding roller group 20 on the operation panel 57. In response to the notification of the end of life of the sheet feeding roller group 20 provided on the operation panel 57, the operator replaces the sheet feeding roller group 20 as described above (see FIG. 2).

Normally, after replacing the sheet feeding roller group 20, the operator operates the operation panel 57 to clear (reset) the life information about the sheet feeding roller group 20. This operation allows the printer 100 to correctly determine the life state of the sheet feeding roller group 20. However, this operation of clearing the life information about the sheet feeding roller group 20 by the operator is operator-dependent, and the operator may forget to clear the life information. Therefore, in the first embodiment, renewal detection control is provided for correctly determining the life state of the sheet feeding roller group 20 even if the operator forgets to perform the clearing operation.

<Renewal Detection Control>

Figure 5B:
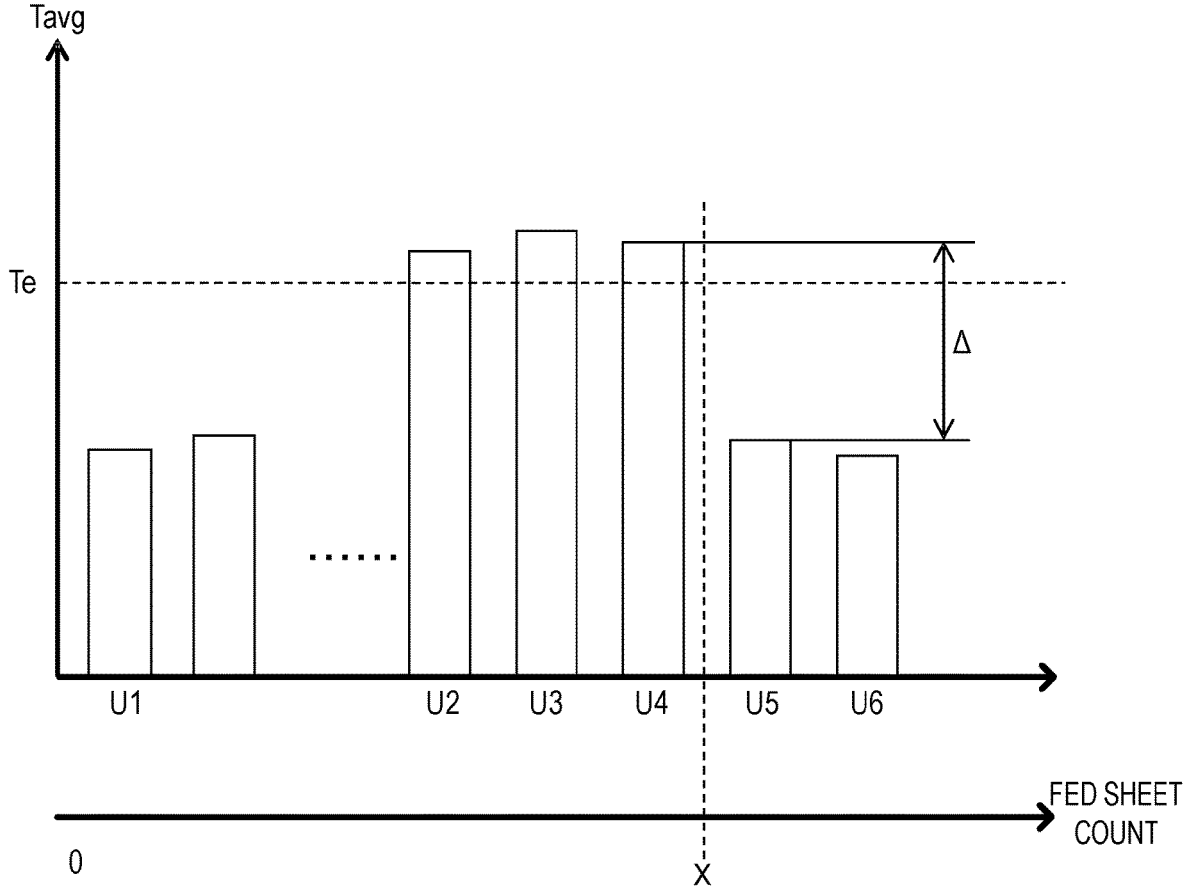
Figure 6:
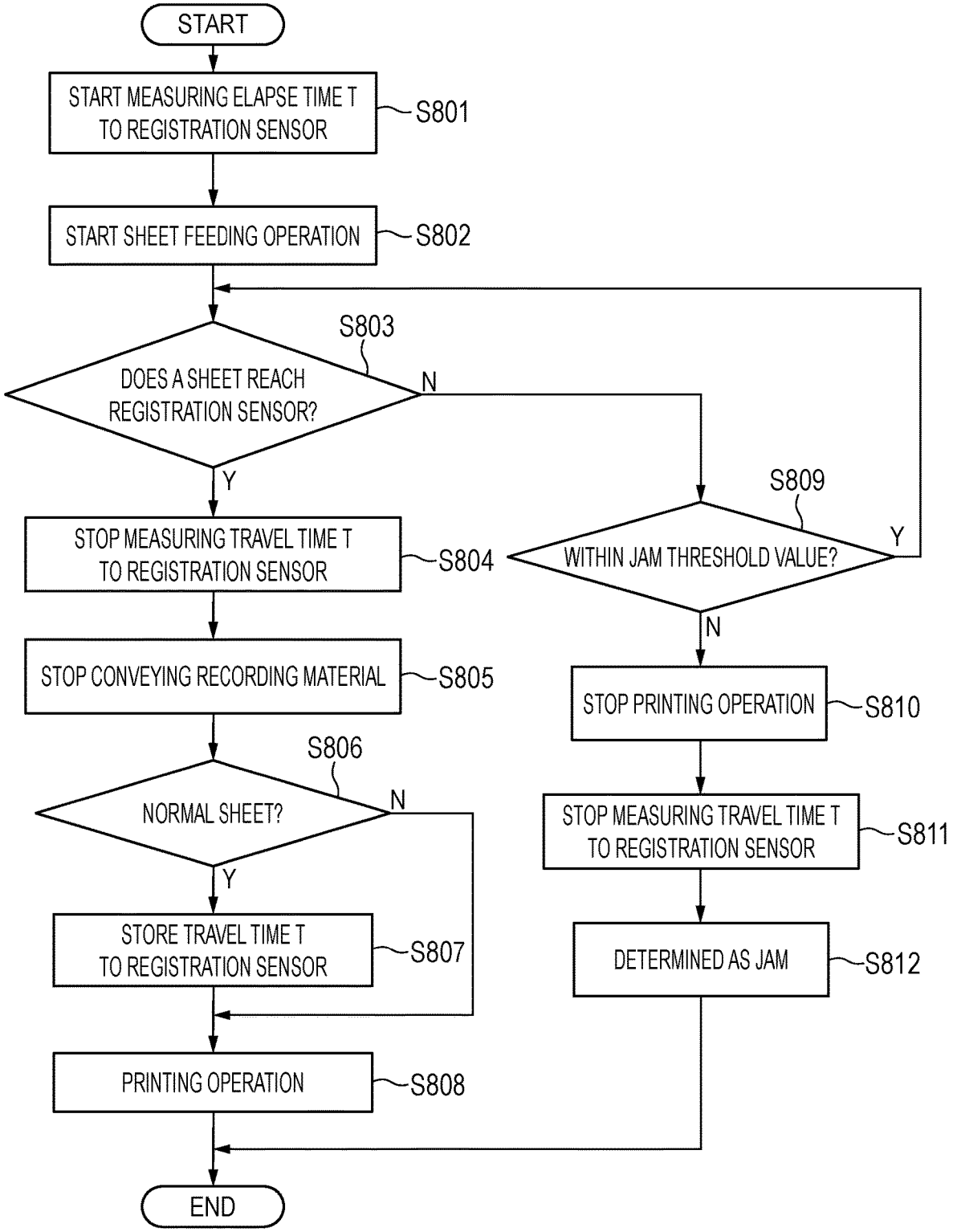
FIG. 6 is a flowchart illustrating the process of acquiring the travel time to a registration sensor during printing operations in the first embodiment.
Figure 7:
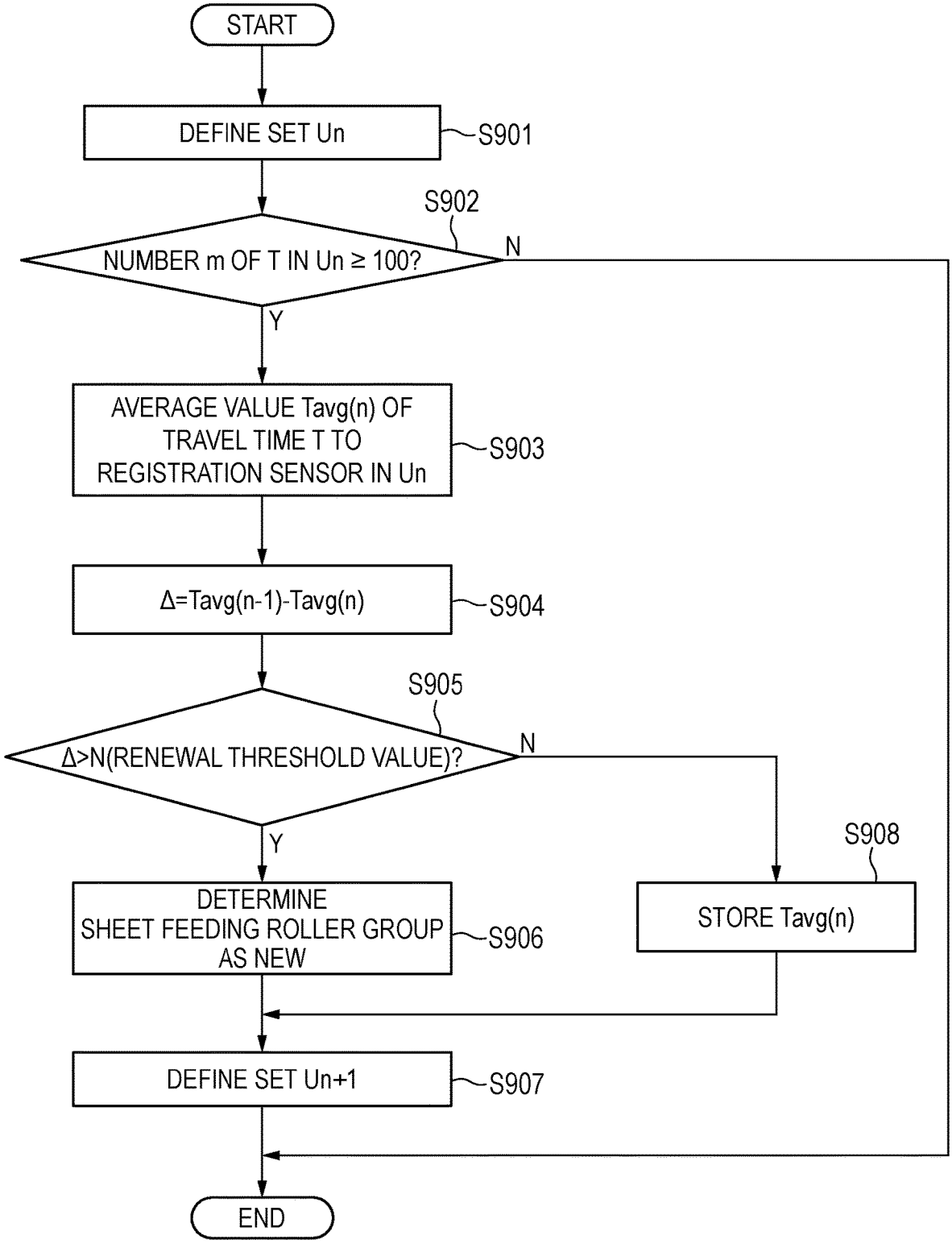
FIG. 7 is a flowchart illustrating the process of renewal detection for the sheet feeding roller group in the first embodiment.

Renewal detection control, which is a feature of the present invention, will be described in detail with reference to FIGS. 5A and 5B to FIG. 7. FIG. 5B is a diagram illustrating shifts in the average travel time to the registration sensor T in the first embodiment. FIG. 6 is a flowchart illustrating the process of acquiring the travel time to the registration sensor T during the printing operations in the printer 100 in the first embodiment. FIG. 7 is a flowchart illustrating the process of the renewal detection for the sheet feeding roller group 20 in the first embodiment.

As in the interval illustrated as Q3 in FIG. 5A, in the late period of the life of the sheet feeding roller group 20, the travel time to the registration sensor T takes relatively large values. In this state, if the sheet feeding roller group 20 is replaced with a new one at the point X, the travel time to the registration sensor T decreases as in the interval illustrated as Q4. That is, the conveyance performance of the sheet feeding roller group 20 is improved, resulting in faster arrival at the registration sensor 45. The present invention utilizes this characteristic to perform the renewal detection.

FIG. 5B is a diagram illustrating shifts in the average Tavg (average time) of elapsed times to reach the registration sensor T. Tavg is a parameter indicating a characteristic of a set U, which is a data set including the elapsed times to reach the registration sensor T measured in the period between removal/insertion operations of the sheet feeding cassette 44. In FIG. 5B, the abscissa indicates sets U and the fed sheet count, and the ordinate indicates the average Tavg of elapsed times to reach the registration sensor T. In the set U1 for which the sheet feeding roller group 20 is new, the average Tavg takes a small value below the life threshold value Te. However, in the sets U2, U3 and U4 for which the sheet feeding roller group 20 has continually been used, the average Tavg takes values larger than the life threshold value Te. In the first embodiment, as described above, the output unit 63 notifies the operator of the end of life of the sheet feeding roller group 20, for example on the operation panel 57, at the end of the set U2 where Tavg>Te. Once the sheet feeding roller group 20 is replaced at the point X, the average Tavg significantly decreases below the life threshold value Te between the set U4 and the set U5. In the first embodiment, the determination unit 62 determines that the sheet feeding roller group 20 is new if this amount of change 4 of the average Tavg is larger than a predetermined value. That is, the determination unit 62 determines that the sheet feeding roller group 20 is new based on the change (e.g. the amount of change of the time) from the start of feeding the recording material S to the detection of the recording material S by the registration sensor 45. This amount of change depends on the type of the recording material S and the degree of abrasion of the sheet feeding roller group 20.

<Process of Acquiring Elapsed Time to Reach Registration Sensor T>

The process of the renewal detection for the sheet feeding roller group 20 will be described in detail below. First, the process of acquiring the travel time to the registration sensor T to be used as the criterion for the renewal detection will be described with reference to FIG. 6. Upon start of the printing operations in the printer 100, the main body control unit 55 causes the measurement unit 61 to start measuring the travel time to the registration sensor T at step (hereinafter denoted as S) 801. At S802, the main body control unit 55 causes the drive control unit 65 to start the operation of feeding the recording material S. At S803, the main body control unit 55 determines whether the leading edge of the recording material S reaches the registration sensor 45. If it is determined at S803 that the leading edge of the recording material S reaches the registration sensor 45, the main body control unit 55 advances the process to S804; otherwise, the main body control unit 55 advances the process to S809.

At S809, the main body control unit 55 determines whether the travel time to the registration sensor T measured by the measurement unit 61 is within a predetermined period of time (hereinafter referred to as a jam threshold value). That is, the main body control unit 55 determines whether the recording material S reaches the registration sensor 45 within a predetermined period of time from the start of feeding the recording material S; the predetermined period of time is determined based on the distance along the conveyance path between the position Ps and the position Prg in FIGS. 4A to 4D, and on the conveyance speed of the recording material S. If the recording material S does not reach the registration sensor 45 within the predetermined period of time, the main body control unit 55 determines the occurrence of a conveyance failure (a jam such as a paper jam) of the recording material S in the conveyance path. If it is determined at S809 that the travel time to the registration sensor T is within the jam threshold value, the main body control unit 55 returns the process to S803. If it is determined at S809 that the travel time to the registration sensor T is not within the jam threshold value, i.e., the recording material S does not reach the registration sensor 45 within the predetermined period of time, the main body control unit 55 advances the process to S810. The main body control unit 55 stops the printing operations at S810, causes the measurement unit 61 to stop measuring the travel time to the registration sensor T at S811, determines the occurrence of a jam at S812, and terminates the process.

At S804, the travel time to the registration sensor T is within the jam threshold value and therefore the main body control unit 55 terminates measuring the travel time to the registration sensor T. At S805, for synchronization with the image forming operations, the main body control unit 55 causes the drive control unit 65 to stop the conveyance of the recording material S. At this point, the main body control unit 55 causes the media sensor 46 to measure characteristics of the recording material S such as the basis weight and a surface property. The measurement unit 61 outputs the information about the recording material S obtained by the media sensor 46 to the determination unit 62. At S806, the main body control unit 55 causes the determination unit 62 to determine whether the recording material S is plain paper based on the result of the measurement by the media sensor 46. If it is determined at S806 that the recording material S is plain paper, the main body control unit 55 advances the process to S807; otherwise, the main body control unit 55 advances the process to S808. The recording material S is identified not as plain paper if the recording material S is thin paper thinner than plain paper, or if it is cardboard paper thicker than plain paper. At S807, the main body control unit 55 stores the travel time to the registration sensor T measured up to S804 in the memory unit 64. The main body control unit 55 performs the printing operations at S808 and terminates the process. If it is determined at S806 that the recording material S is not plain paper, the main body control unit 55 performs the printing operations without storing the travel time to the registration sensor T measured at S804. Thus, by detecting the type of the recording material S and storing the travel time to the registration sensor T only for plain paper in the memory unit 64, deterioration of the continually used sheet feeding roller group 20 can be accurately detected.

<Renewal Detection Process>

Now, the process of performing the renewal detection for the sheet feeding roller group 20 using the travel time to the registration sensor T acquired in FIG. 6 will be described with reference to the flowchart in FIG. 7. As described above, in the first embodiment, replacing the sheet feeding roller group 20 requires drawing out the sheet feeding cassette 44. Therefore, a set U is defined as including the elapsed times to reach the registration sensor T acquired in the period between two removal/insertion operations for the sheet feeding cassette 44 detected based on outputs from the cassette open/close sensor 80. For example, each interval is defined as the period from an opening/closing operation for the sheet feeding cassette 44 for refilling the recording material S to the next opening/closing operation. Thus, in the first embodiment, an opening/closing operation for the sheet feeding cassette 44 triggers the renewal detection process for the sheet feeding roller group 20.

At S901, the main body control unit 55 serving as a determination unit defines a set Un upon determining that the sheet feeding cassette 44 is opened and closed based on the result of detection by the cassette open/close sensor 80. The set Un includes the elapsed times to reach the registration sensor T in the period from the previous opening/closing operation to the current opening/closing operation for the sheet feeding cassette 44. These elapsed times to reach the registration sensor T are accumulated in the memory unit 64. At S902, the main body control unit 55 counts the number m of data items of the elapsed times to reach the registration sensor T in the set Un to determine whether the number m of data items is not smaller than a predetermined number, for example 100 (whether m is a predetermined number or larger) ($m \geq 100$). If it is determined at S902 that the number m of data items of the elapsed times to reach the registration sensor T in the set Un is not smaller than 100, the main body control unit 55 advances the process to S903; otherwise, the main body control unit 55 terminates the process. In the first embodiment, the renewal detection process is terminated if the number m of data items of the elapsed times to reach the registration sensor T in the set Un is smaller than 100. In the first embodiment, 100 is set as the minimum number m of data items of the elapsed times to reach the registration sensor T in the set Un for performing the renewal detection. This is because too few samples in the set Un may reduce the detection accuracy, leading to erroneous detection.

At S903, the main body control unit 55 calculates the average Tavg(n) of the elapsed times to reach the registration sensor T in the set Un, which is a second data set. At S904, the main body control unit 55 calculates the difference Δ between the average Tavg(n) and the previous average Tavg(n−1) stored in the memory unit 64. The average Tavg(n−1) is the average of the elapsed times to reach the registration sensor T in the set Un−1, which is a first data set. Here, the difference Δ is determined as 4=Tavg(n−1)−Tavg(n). This difference Δ is the determination condition of the renewal detection for the sheet feeding roller group 20 in the first embodiment. At S905, the main body control unit 55 determines whether Δ is larger than a renewal threshold value N (a predetermined value) (Δ>N). If it is determined at S905 that the difference Δ is larger than the renewal threshold value N, the main body control unit 55 advances the process to S906; otherwise, the main body control unit 55 advances the process to S908. At S906, the main body control unit 55 determines that the sheet feeding roller group 20 is new. At this point, it is determined that the sheet feeding roller group 20 was inserted at the start of the set Un, in other words, at the time of the opening/closing operation for the sheet feeding cassette 44. At S908, the main body control unit 55 stores the average Tavg(n) of the elapsed times to reach the registration sensor T in the set Un calculated at S903 in the memory unit 64 for use in the renewal detection process at the time of the next opening/closing operation for the sheet feeding cassette 44. At S907, the main body control unit 55 defines the set Un+1 between the current opening/closing operation and the next opening/closing operation for the sheet feeding cassette 44, and terminates the process.

As described above, according to the first embodiment, it can be determined whether the sheet feeding roller group 20 is new from the travel time to the registration sensor T. Because this detection utilizes the chronological relationship of the elapsed times to reach the registration sensor T in the main body of the same printer 100, the detection accuracy is not affected by variations among main bodies of different printers 100. Therefore, even if the operator forgets to reset the life state after replacing the sheet feeding roller group 20, it can automatically be detected that the sheet feeding roller group 20 is new. Thus, the life state of the inserted sheet feeding roller group 20 can again be detected to prevent future conveyance failures, such as jams and printing failures.

In the first embodiment, a measured travel time to the registration sensor T is employed on the condition that the recording material S is plain paper. Instead, the condition may be that the recording material S is cardboard paper or thin paper. Under such a condition, setting a renewal threshold value N appropriate for the paper type of the recording material frequently used by the user allows accurate detection of the life state of the sheet feeding roller group. However, the number m of data items of the elapsed times to reach the registration sensor T is desirably larger for accurate detection. Although the media sensor 46 is used for determining the type of the recording material S, the present invention is not limited to this; rather, the paper type may be entered by the user. Although the type of the recording material S is used as the condition for the travel time to the registration sensor T in the first embodiment, other conditions such as environmental conditions (temperature or humidity) may be added as necessary. Generally, in an environment at low temperature and humidity, the sheet feeding roller 25 tends to slip on the recording material S. With respect to reference temperature and humidity, for example ordinary temperature and humidity, the travel time to the registration sensor T tends to be shorter at higher temperatures and humidities and to be longer at lower temperatures and humidities. Therefore, the threshold for the travel time to the registration sensor T may be varied with the temperature and humidity. In this case, for example, the printer 100 may include a sensor that detects the temperature and/or humidity, and, according to the result of detection by the sensor, determine whether to store the travel time to the registration sensor T in the memory unit 64. The above conditions may also be eliminated if acceptable determination performance is achieved without such conditions.

In the first embodiment, the average Tavg of the elapsed times to reach the registration sensor T is used as the condition for determining whether the sheet feeding roller group 20 is new. Instead, some other parameter that depends on the use may be used, for example the maximum or the extent of variation of the elapsed times to reach the registration sensor T in the set Un. Further, although the start and end of the sets U in the first embodiment are defined by the removal/insertion operations for the sheet feeding cassette 44, the present invention is not limited to this. Rather, the sets U may be defined by time or the fed sheet count. For example, the sets U may be defined at predetermined time intervals. As another example, the main body control unit 55 may include a counter that counts the fed sheet count, and a set U may be defined for each predetermined number of sheets of recording material S being fed.

Thus, according to the first embodiment, replacement of a component with a new component can automatically be detected.

Second Embodiment

The first embodiment has been described regarding the case where the renewal detection for the sheet feeding roller group 20 uses the difference Δ between the averages Tavg of the elapsed times to reach the registration sensor T in the sets U before and after the replacement of the sheet feeding roller group 20. A second embodiment will be described regarding an example where a renewal threshold value Tn (a predetermined period of time) for elapsed times to reach the registration sensor T is used. The second embodiment uses more sample data items to determine that the sheet feeding roller group 20 is new, thereby enabling more reliable renewal detection. The components of the printer 100 serving as the apparatus main body and the parameters used for control in the second embodiment are the same as those in the first embodiment, and therefore are given the same symbols and will not be described.

Figure 8:
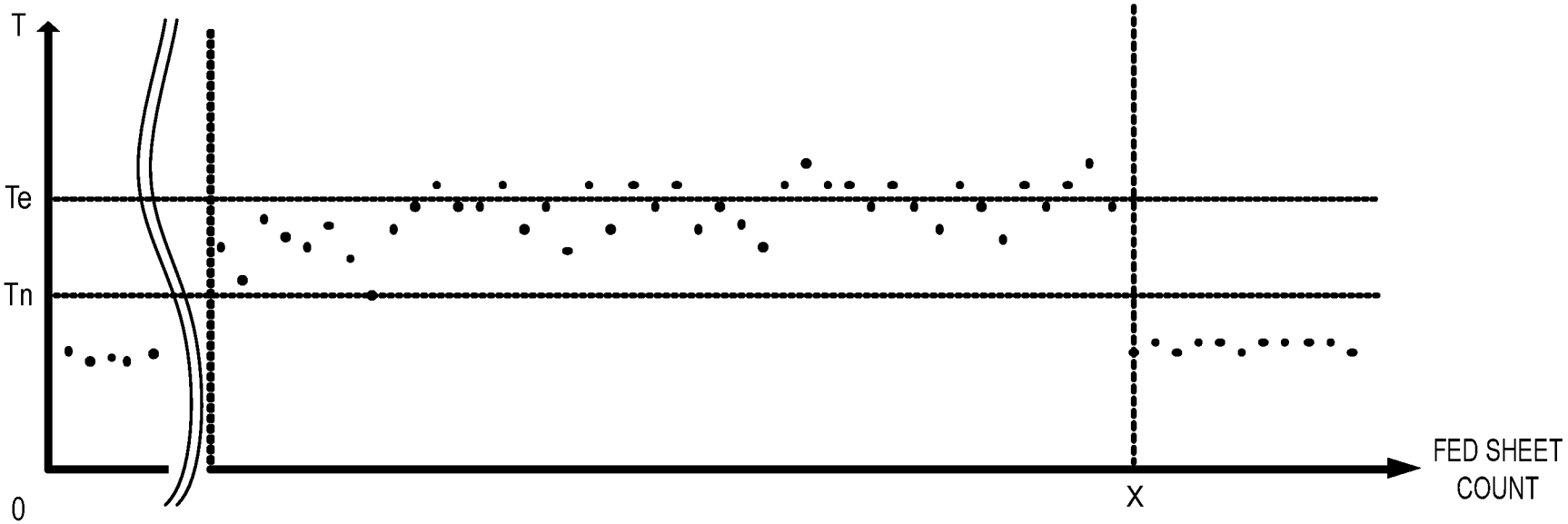
FIG. 8 is a graph illustrating shifts in the travel time to the registration sensor in the second embodiment.
Figure 9:
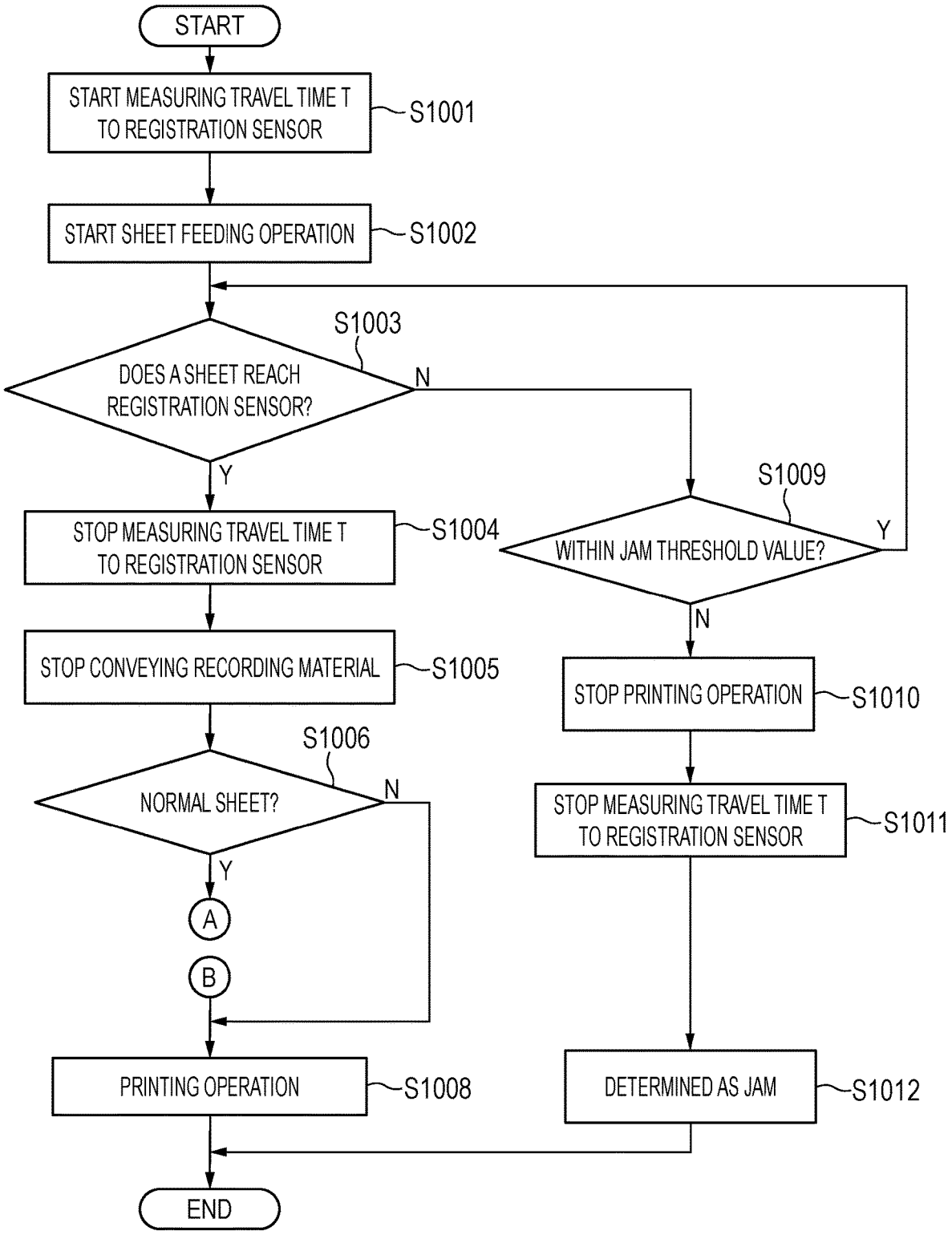
FIG. 9 is a flowchart illustrating the process of renewal detection for the sheet feeding roller group in the second to fourth embodiments.
Figure 10:
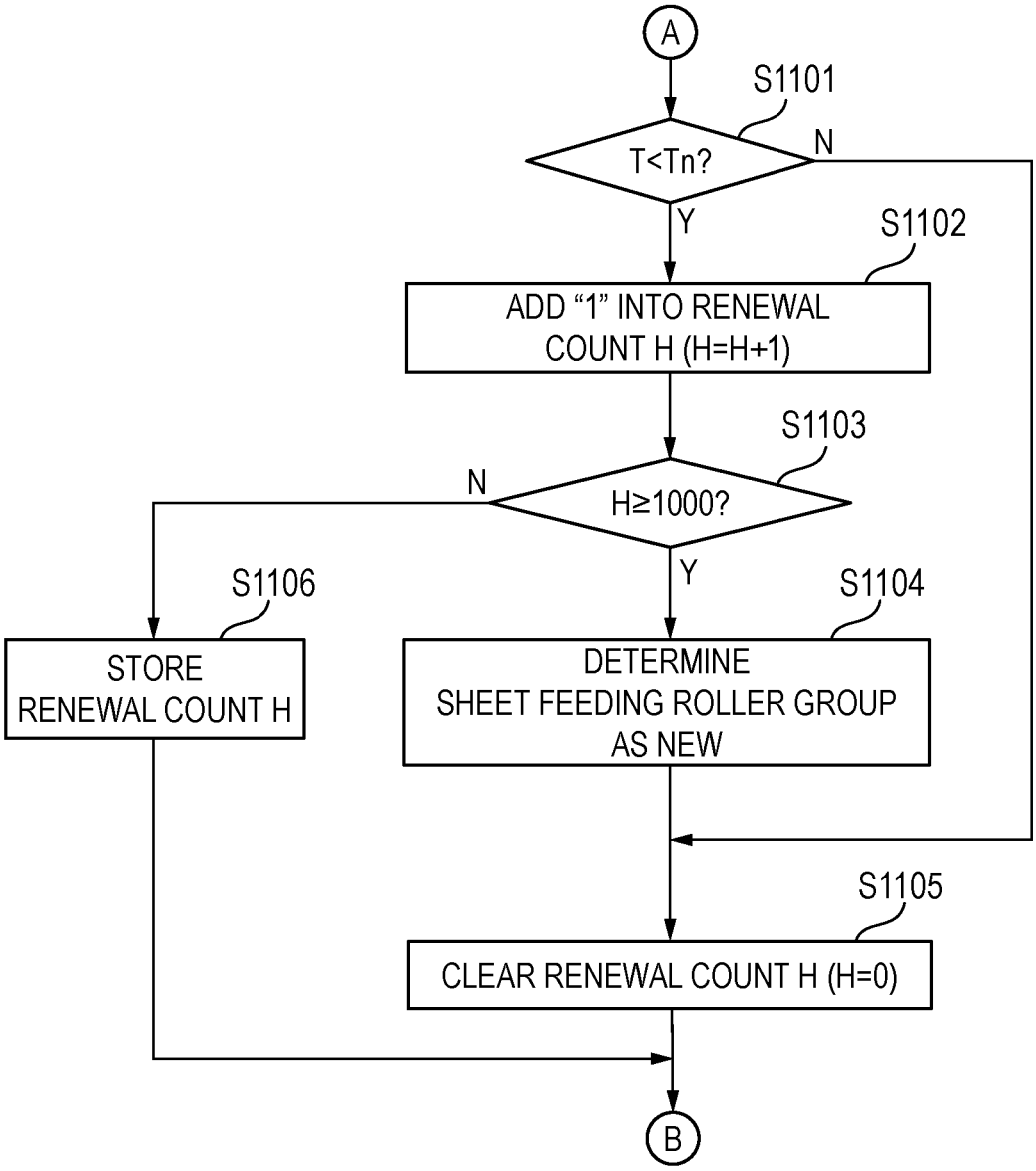
FIG. 10 is a flowchart illustrating the process of the renewal detection for the sheet feeding roller group in the second embodiment.

Renewal detection control in the second embodiment will be described in detail with reference to FIGS. 8 to 10. FIG. 8 is a graph illustrating shifts in the travel time to the registration sensor Tin the second embodiment. FIGS. 9 and 10 are flowcharts illustrating the renewal detection process for the sheet feeding roller group 20 in the second embodiment. In the first embodiment, the operation of removing and inserting the sheet feeding cassette 44 triggers the renewal detection for the sheet feeding roller group 20. In the second embodiment, the renewal detection is performed during normal printing operations after a notification of the end of life of the sheet feeding roller group 20 is provided.

<Renewal Detection Process>

FIG. 8 is a graph in which the abscissa indicates the fed sheet count and the ordinate indicates the travel time to the registration sensor T. As illustrated in FIG. 8, after the sheet feeding roller group 20 at the end of its life is replaced with a new one at the point X, the travel time to the registration sensor T takes smaller values. In the second embodiment, it is determined that the sheet feeding roller group 20 is new (hereinafter referred to as renewal determination) if the travel time to the registration sensor T successively takes a predetermined number of values not larger than the renewal threshold value Tn after the replacement of the sheet feeding roller group 20. Te denotes the life threshold value described in the first embodiment and has the relationship Te>Tn.

The renewal detection process for the sheet feeding roller group 20 in the second embodiment will be described below. After a notification of the end of life of the sheet feeding roller group 20 is provided, the renewal detection process starts upon start of the printing operations. While the detection of the end of life of the sheet feeding roller group 20 is the trigger for starting the renewal detection process in FIG. 9, the process may be triggered when the average Tavg of the elapsed times to reach the registration sensor T in a predetermined period (in a set U) exceeds the life threshold value Te, as in the first embodiment. The renewal detection process in FIG. 9 may also be triggered when it is determined that the sheet feeding roller group 20 reaches the end of its life with a known technique for detecting the end of life of the sheet feeding roller group 20.

The renewal detection process of FIG. 9 will be explained below. Upon start of the printing operations in the printer 100, the main body control unit 55 transitions to S1001. At S1001, the main body control unit 55 causes the measurement unit 61 to start measuring the travel time to the registration sensor T. At S1002, the main body control unit 55 causes the drive control unit 65 to start the operation of feeding the recording material S. At S1003, the main body control unit 55 determines whether the leading edge of the recording material S being fed reaches the registration sensor 45. If it is determined at S1003 that the leading edge of the recording material S reaches the registration sensor 45, the main body control unit 55 advances the process to S1004; otherwise, the main body control unit 55 advances the process to S1009. At S1009, the main body control unit 55 determines whether the recording material S reaches the registration sensor 45 within a predetermined period of time (the jam threshold value). If it is determined that the recording material S reaches within the jam threshold value, the main body control unit 55 returns the process to S1003; otherwise, the main body control unit 55 advances the process to S1010. The main body control unit 55 stops the printing operations at S1010, causes the measurement unit 61 to stop measuring the travel time to the registration sensor Tat S1011, determines the occurrence of a jam at S1012, and terminates the process.

At S1004, the main body control unit 55 causes the measurement unit 61 to stop measuring the travel time to the registration sensor T. At S1005, the main body control unit 55 stops the conveyance of the recording material S at the position of the registration sensor 45 and causes the media sensor 46 to measure characteristics of the recording material S such as the basis weight and a surface property. At S1006, the main body control unit 55 determines whether the recording material S is plain paper based on the result of the detection by the media sensor 46 at S1005. If it is determined at S1006 that the recording material S is plain paper, the main body control unit 55 advances the process to S1101 in FIG. 10; otherwise, the main body control unit 55 advances the process to S1008 without performing any particular processing.

At S1101 in FIG. 10, the main body control unit 55 determines whether the travel time to the registration sensor T is smaller than the renewal threshold value Tn. If it is determined at S1101 that the travel time to the registration sensor T is smaller than the renewal threshold value Tn ($T<Tn$), the main body control unit 55 advances the process to S1102. At S1102, the main body control unit 55 adds 1 to a renewal count H ($H=H+1$). The renewal count H is a variable for counting the number of times the travel time to the registration sensor T successively takes a value smaller than the renewal threshold value Tn (an amount of time shorter than the predetermined period of time) ($T<Tn$). If it is determined at S1101 that the travel time to the registration sensor T is not smaller than the renewal threshold value Tn ($T\geq Tn$), the main body control unit 55 advances the process to S1105. In this case, at S1105, the main body control unit 55 does not determine that the sheet feeding roller group 20 is replaced with a new one, and resets (clears) the renewal count H to 0 ($H=0$) and advances the process to S1008 in FIG. 9.

At S1103, the main body control unit 55 determines whether the renewal count H is not smaller than a predetermined number, for example 1000 (whether H is a predetermined number or larger). In the second embodiment, the main body control unit 55 determines that the sheet feeding roller group 20 is new if $H (=H+1)\geq 1000$, for example. That is, the main body control unit 55 determines that the sheet feeding roller group 20 has been replaced with a new one if the travel time to the registration sensor T successively takes a value smaller than the renewal threshold value Tn for 1000 sheets. If it is determined at S1103 that the renewal count H is not smaller than 1000, the main body control unit 55 advances the process to S1104. At S1104, the main body control unit 55 determines that the sheet feeding roller group 20 is new (renewal determination), and clears the renewal count H at S1105 and advances the process to S1008. By contrast, if it is determined at S1103 that the renewal count H is smaller than 1000 ($H (=H+1)<1000$), i.e., the number of successive values $T<Tn$ is smaller than 1000, the main body control unit 55 advances the process to S1106. At S1106, the main body control unit 55 stores the renewal count H ($=H+1$) in the memory unit 64 and advances the process to S1008. At S1008, the main body control unit 55 performs printing operations and terminates the process.

As described above, in the second embodiment, it can be determined whether the sheet feeding roller group 20 is new from the travel time to the registration sensor T, as in the first embodiment. In addition, the determination is also based on detecting that the travel time to the registration sensor T drops from a value not smaller than the life threshold value Te and successively takes a value not larger than the renewal threshold value Tn for a predetermined number of sheets. This allows accurately detecting that the sheet feeding roller group 20 is new. Therefore, even if the operator forgets to reset the life state of the sheet feeding roller group 20 after replacing the sheet feeding roller group 20, it can automatically be detected that the sheet feeding roller group 20 is new. Thus, the life state of the inserted sheet feeding roller group 20 can again be detected to prevent future conveyance failures, such as jams and printing failures. In the second embodiment, a measured travel time to the registration sensor T is employed on the condition that the recording material S is plain paper. The same effect can also be achieved using the condition that the recording material S is cardboard paper or thin paper. However, as described above, the number of data items of the elapsed times to reach the registration sensor T is desirably larger for accurate detection. Although the media sensor 46 is used for determining the type of the recording material S in the second embodiment, the present invention is not limited to this; rather, the type of the recording material S may be based on user input.

Thus, according to the second embodiment, replacement of a component with a new component can automatically be detected.

Third Embodiment

The first embodiment has been described regarding the case where the renewal detection for the sheet feeding roller group 20 uses the difference $\Delta(=Tavg(n-1)-Tavg(n))$ between the averages Tavg of the elapsed times to reach the registration sensor T in two sequential sets U (Un−1 and Un). In a third embodiment, summary statistics are calculated based on the elapsed times to reach the registration sensor T in each set U to calculate a Mahalanobis' distance $D^2$ from a reference summary statistic. The difference $\Delta$ between two sequential Mahalanobis' distances is then used to perform the renewal detection for the sheet feeding roller group 20. As an example, the third embodiment uses two variates, the 25th percentile and the 75th percentile, as the summary statistics. Here, the 25th percentile denotes the median of the data in the lower subset smaller than the median of the data in the set U of the elapsed times to reach the registration sensor T. The 75th percentile denotes the median of the data in the upper subset larger than the median of the data in the set U of the elapsed times to reach the registration sensor T.

<Renewal Detection Process>

Figure 11:
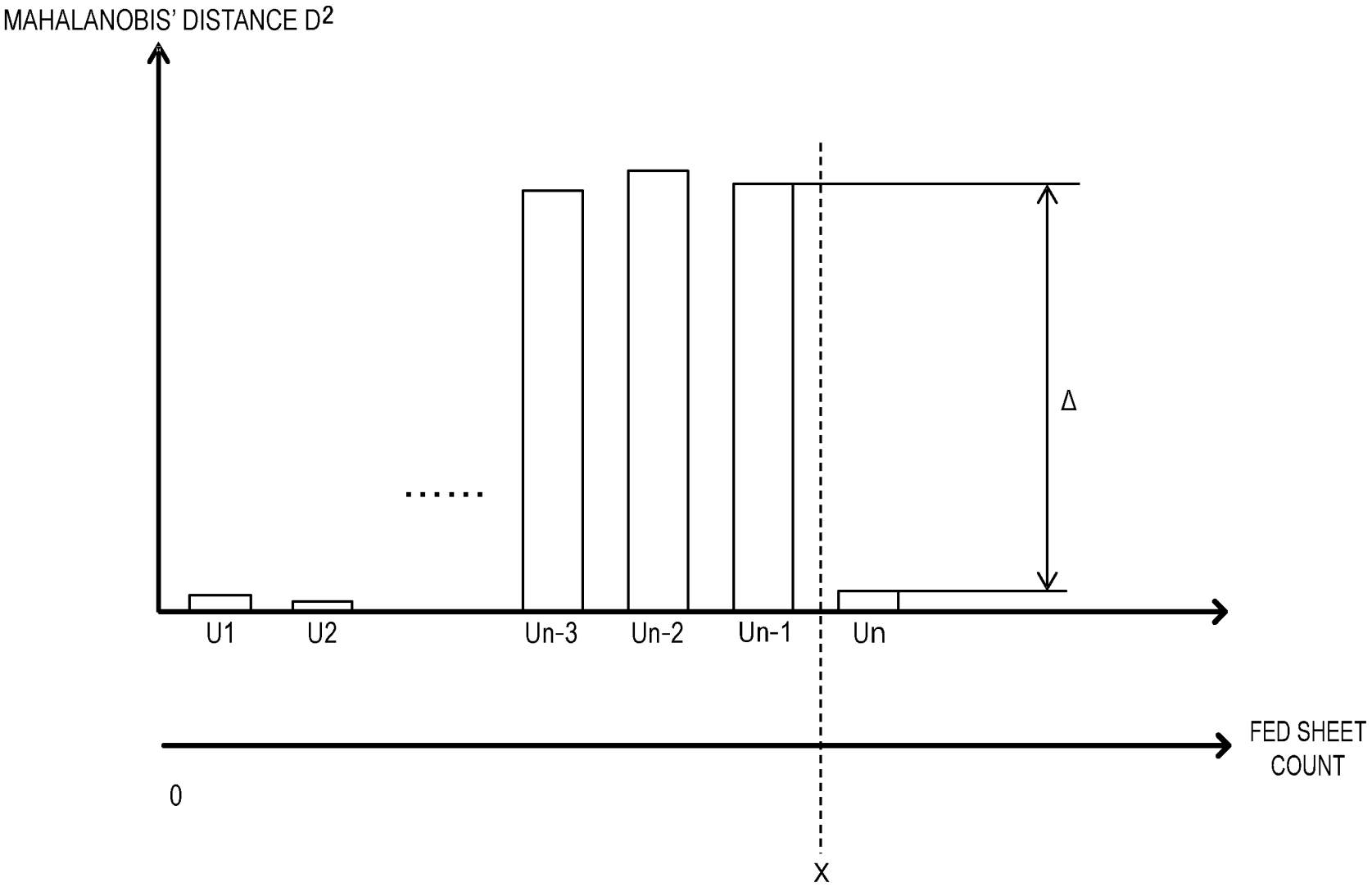
FIG. 11 is a graph illustrating shifts in the Mahalanobis' distance in the third embodiment.

Renewal detection control in the third embodiment will be described in detail with reference to FIGS. 11 and 12. FIG. 11 is a graph illustrating shifts in the Mahalanobis' distance $D^2$ in which each set U includes the elapsed times to reach the registration sensor T resulting from feeding a predetermined number of sheets of recording material S. Here, the set Un is the n-th set U, where n is an integer not smaller than 2 and indicates the set number. In FIG. 11, the abscissa indicates the fed sheet count, and the ordinate indicates the Mahalanobis' distance $D^2$ of each set U of the elapsed times to reach the registration sensor T resulting from feeding the predetermined number of sheets of recording material S. In the set U1 for which the sheet feeding roller group 20 is new, the Mahalanobis' distance $D^2(1)$ takes a small value. In the sets Un−2 and Un−1 for which the sheet feeding roller group 20 has continually been used, the Mahalanobis' distances $D^2(n-2)$ and $D^2(n-1)$ take large values. As described in the first embodiment, the Mahalanobis' distance $D^2$ significantly decreases between the Un−1 and the Un once the sheet feeding roller group 20 is replaced at the point X after the notification of the end of life of the sheet feeding roller group 20 is provided (after Tavg>Te is observed). In the third embodiment, it is determined that the sheet feeding roller group 20 is new if this amount of change (difference) Δ in Mahalanobis' distance $D^2$ is larger than a predetermined value.

Figure 12:
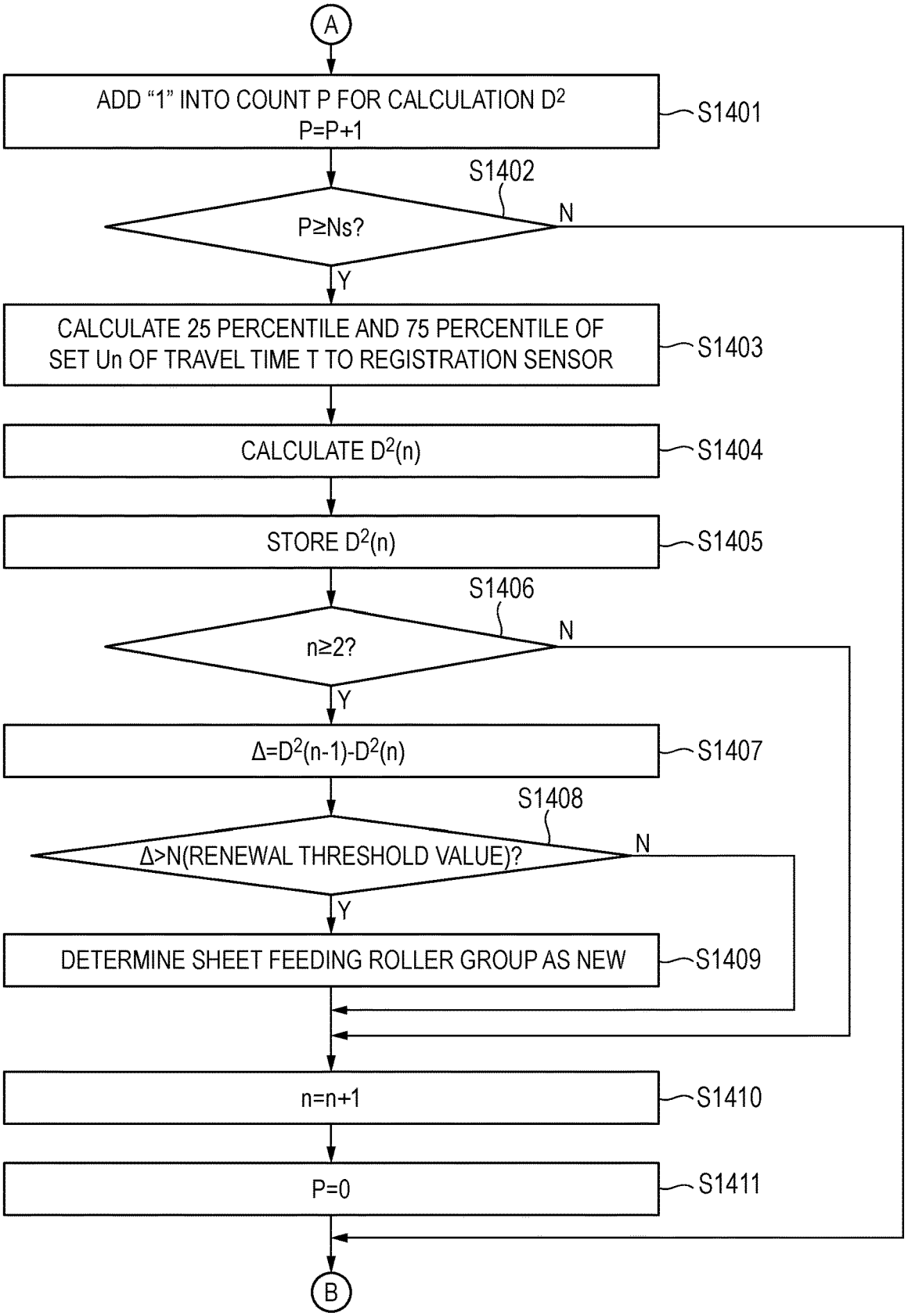
FIG. 12 is a flowchart illustrating the process of the renewal detection for the sheet feeding roller group in the third embodiment.

FIGS. 9 and 12 are flowcharts illustrating the renewal detection process for the sheet feeding roller group 20 in the third embodiment. After a notification of the end of life of the sheet feeding roller group 20 is provided, the main body control unit 55 starts the renewal detection process upon start of the printing operations. S1001 to S1012 in FIG. 9 will not be described. If it is determined at S1006 in FIG. 9 that the recording material S is plain paper, the main body control unit 55 performs the processing at S1401 in FIG. 12.

Here, the set Un is a set of the elapsed times to reach the registration sensor T for a predetermined number of samples Ns, for example 20 sheets (Ns=20). At S1401, in order to define the set Un, the main body control unit 55 adds 1 to a count P (P=P+1), which is a variable for calculating the Mahalanobis' distance $D^2$. At S1402, the main body control unit 55 determines whether the count P is not smaller than Ns (=20). If it is determined at S1402 that the count P is smaller than Ns, the main body control unit 55 advances the process to S1008 in FIG. 9; otherwise, the main body control unit 55 advances the process to S1403. At S1403, the main body control unit 55 determines the 25th percentile and the 75th percentile of the set Un of the elapsed times to reach the registration sensor T. At S1404, the main body control unit 55 calculates the Mahalanobis' distance $D^2(n)$ of the set Un based on the 25th percentile and the 75th percentile of the set Un determined at S1403, and stores the result of the calculation in the memory unit 64 at S1405.

At S1406, the main body control unit 55 determines whether the set number n of the set Un stored in the memory unit 64 is not smaller than 2. If it is determined at S1406 that the set number n is not smaller than 2, the main body control unit 55 advances the process to S1407; otherwise, the main body control unit 55 advances the process to S1410. At S1407, the main body control unit 55 calculates the difference between the Mahalanobis' distance $D^2(n-1)$ of the previous set Un−1 stored in the memory unit 64 and the Mahalanobis' distance $D^2(n)$ of the current set Un calculated at S1405 ($4=D^2(n-1)-D^2(n)$). That is, the main body control unit 55 calculates the difference Δ between the successively acquired Mahalanobis' distances $D^2(n-1)$ and $D^2(n)$. This difference Δ is the determination condition of the renewal detection for the sheet feeding roller group 20 in the third embodiment; the main body control unit 55 determines that the sheet feeding roller group 20 is new if the difference Δ is larger than the renewal threshold value N (4>N). If so, the sheet feeding roller group 20 is regarded as having been replaced at the start of the set Un.

At S1408, the main body control unit 55 determines whether the difference calculated at S1407 is larger than the renewal threshold value N. If it is determined at S1408 that the difference Δ is larger than the renewal threshold value N, the main body control unit 55 advances the process to S1409; otherwise, the main body control unit 55 advances the process to S1410. At S1409, the main body control unit 55 determines that the sheet feeding roller group 20 is new. At S1410, the main body control unit 55 adds 1 to the set number n of the set Un (n=n+1) in order to define the next set Un+1, and clears the count P (P=0) at S1411 and advances the process to S1008 in FIG. 9.

<Mahalanobis' Distance $D^2$>

The Mahalanobis' distance $D^2$ defined in the third embodiment is given by the following Equation (1).

$$D^2 = \frac{1}{k}[X \quad Y]\begin{pmatrix} 1 & r \\ r & 1 \end{pmatrix}^{-1}\begin{bmatrix} X \\ Y \end{bmatrix} \qquad \text{Equation (1)}$$

$$X = \frac{x_i - \bar{x}}{\sigma_x},\ Y = \frac{y_i - \bar{y}}{\sigma_y}$$

k: the number of variates $x_i$: the 25th percentile of the set Un of the elapsed times to reach the registration sensor T $y_i$: the 75th percentile of the set Un of the elapsed times to reach the registration sensor T $\bar{x}$: the reference value of the 25th percentile of the set Un of the elapsed times to reach the registration sensor T $\bar{y}$: the reference value of the 75th percentile of the set Un of the elapsed times to reach the registration sensor T $\sigma_x$: the reference standard deviation of the reference 25th percentile of the set Un of the travel time to the registration sensor T $\sigma_y$: the reference standard deviation of the reference 75th percentile of the set Un of the travel time to the registration sensor T r: the correlation coefficient of reference X and Y As a specific example, the following describes the set Un−1 for the continually used sheet feeding roller group 20, and the set Un after the replacement with a new sheet feeding roller group 20 at the point X. The parameters in calculating the Mahalanobis' distance $D^2(n-1)$ in the third embodiment are as follows.

k=2

$\bar{x}$=224.634

$\bar{y}$=228.275

$\sigma_x$=3.1183592

$\sigma_y$=1.131647 r=0.5340643

If the data $x_i$ and $y_i$ of the set Un−1 for the sheet feeding roller group 20 at the end of its life take the values below, the Mahalanobis' distance $D^2(n-1)$ of the set Un−1 is calculated as 112.99313.

$x_i$=242

$y_i$=245

If the data $x_i$ and $y_i$ of the set Un after the replacement of the sheet feeding roller group 20 with a new one take the values below, the Mahalanobis' distance $D^2(n)$ of the set Un is calculated as 0.413352.

$x_i$=224

$y_i$=229

This results in the difference $\Delta=D^2(n-1)-D^2(n)=112.57978$.

As described above, according to the third embodiment, it can be determined whether the sheet feeding roller group 20 is new from the Mahalanobis' distances $D^2$. Because this detection utilizes the chronological relationship of the elapsed times to reach the registration sensor T in the main body of the same printer 100, the detection accuracy is not affected by variations among printers. Therefore, in the event of an operation error, such as the operator forgetting to reset the life state after replacing the sheet feeding roller group 20, it can automatically be detected that the sheet feeding roller group 20 is new. Thus, the life state of the inserted sheet feeding roller group 20 can again be detected to prevent future conveyance failures, such as jams and printing failures.

Although the 25th percentile and the 75th percentile are used as the summary statistics in the example in the third embodiment, other values such as the average, median, maximum, minimum, and standard deviation may also be used as the summary statistics. For reducing the extent of variations in the results for the set Un, the number of sheets defining the set Un may be changed, or the results of calculations for the set Un may be filtered. As exemplary filtering, the results of calculations may be regarded as valid if variations in the results of a certain number of successive calculations are within a predetermined range.

Thus, according to the third embodiment, replacement of a component with a new component can automatically be detected.

Fourth Embodiment

The third embodiment has been described regarding the example where the data in the set U of the elapsed times to reach the registration sensor T resulting from feeding a predetermined number of sheets of recording material S include data acquired either before or after the replacement of the sheet feeding roller group 20. A fourth embodiment will be described regarding the case where the data in the set U includes both data acquired before the replacement of the sheet feeding roller group 20 and data acquired after the replacement. That is, the following describes the case where the sheet feeding roller group 20 is replaced with a new one while the elapsed times to reach the registration sensor T in the set U are being acquired.

<Renewal Detection Process>

Figure 13:
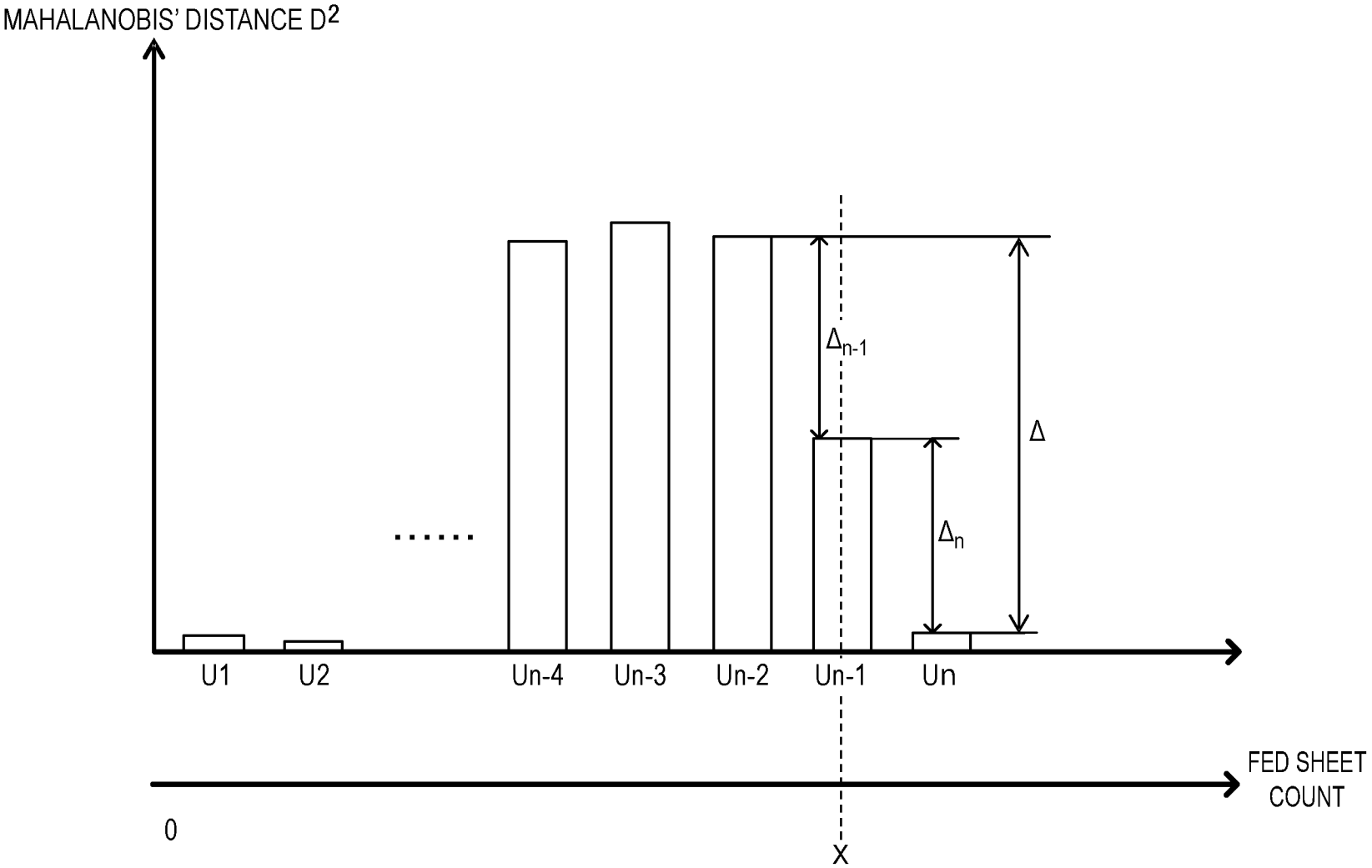
FIG. 13 is a graph illustrating shifts in the Mahalanobis' distance in the fourth embodiment.

FIG. 13 is a graph similar to the graph in FIG. 11, and illustrates shifts in the Mahalanobis' distance $D^2$ in the fourth embodiment in which each set U includes the elapsed times to reach the registration sensor T resulting from feeding a predetermined number of sheets of recording material S. In FIG. 13, the abscissa indicates the fed sheet count, and the ordinate indicates the Mahalanobis' distance $D^2$ corresponding to each set Un. As illustrated in FIG. 13, in the fourth embodiment, the sheet feeding roller group 20 is replaced at the point X in the process of acquiring the elapsed times to reach the registration sensor T in the set Un−1. Consequently, the set Un−1 includes both data acquired before the replacement of the sheet feeding roller group 20 and data acquired after the replacement. This may result in that the Mahalanobis' distance $D^2(n-1)$ of the set Un−1 takes a value between the Mahalanobis' distance $D^2(n-2)$ of the set Un−2 and the Mahalanobis' distance $D^2(n)$ of the set Un. Here, the difference Δn−1 denotes the difference Δ between the Mahalanobis' distance $D^2(n-2)$ of the set Un−2 and the Mahalanobis' distance $D^2(n-1)$ of the set Un−1. The difference Δn denotes the difference Δ between the Mahalanobis' distance $D^2(n-1)$ of the set Un−1 and the Mahalanobis' distance $D^2(n)$ of the set Un. Then, the differences Δn−1 and Δn both take a value smaller than the renewal threshold value N (Δn−1<N, Δn<N). If these differences Δ (the difference Δn−1 and the difference Δn) each take a value smaller than the renewal threshold value N, the sheet feeding roller group 20 may not be determined as new. Therefore, in the fourth embodiment, the renewal determination uses the Mahalanobis' distance $D^2(n-2)$ of the set Un−2 and the Mahalanobis' distance $D^2(n)$ of the set Un. That is, the difference Δ used for the renewal detection in the fourth embodiment is the difference between the Mahalanobis' distance $D^2(n-2)$ of the set Un−2 and the Mahalanobis' distance $D^2(n)$ of the set Un ($\Delta=D^2(n-2)-D^2(n)$). In the fourth embodiment, the main body control unit 55 calculates the difference Δ between the Mahalanobis' distances $D^2(n-2)$ and $D^2(n)$ acquired for sets with at least one set in between.

Figure 14:
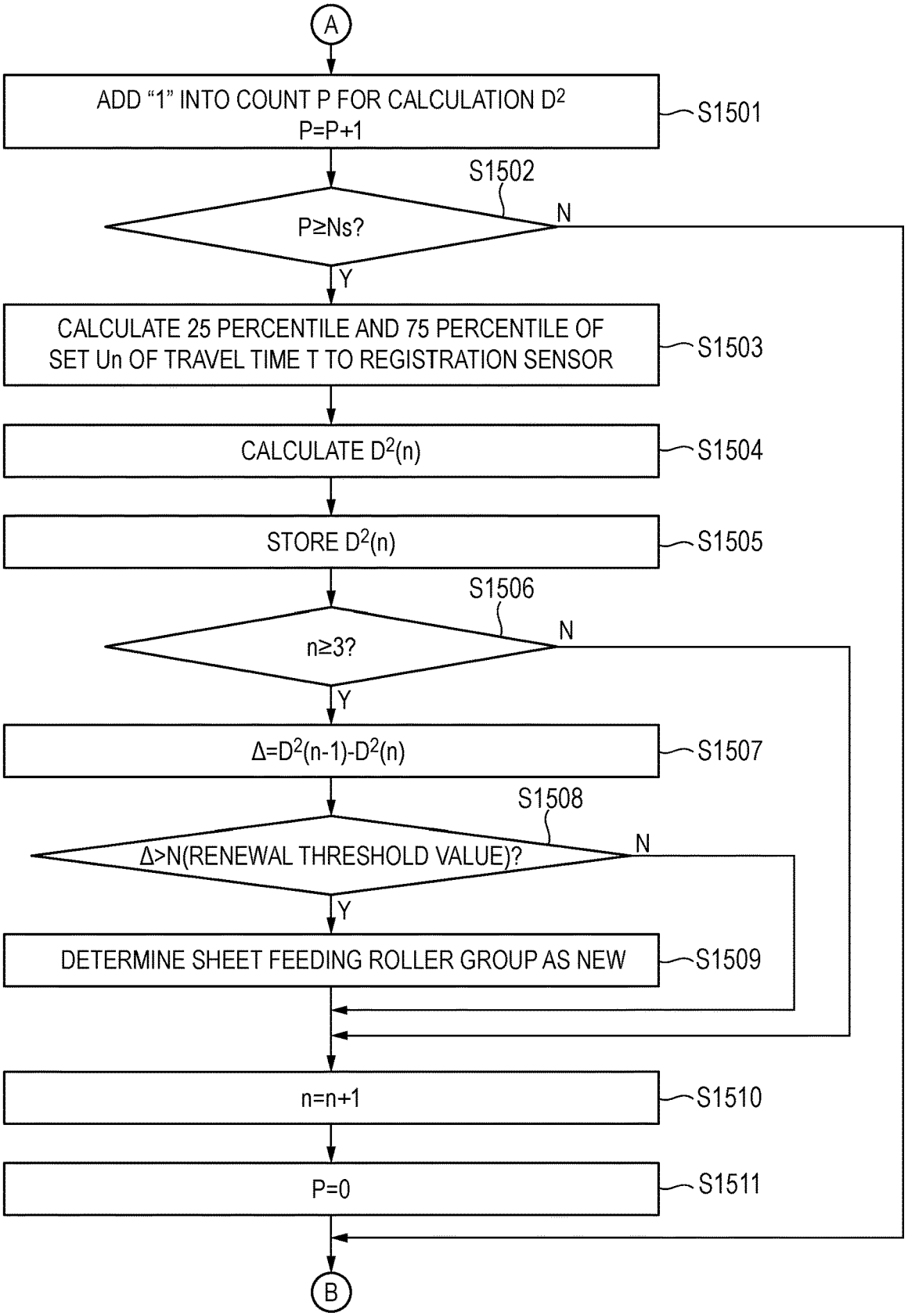
FIG. 14 is a flowchart illustrating the process of the renewal detection for the sheet feeding roller group in the fourth embodiment.

FIGS. 9 and 14 are flowcharts illustrating the renewal detection process for the sheet feeding roller group 20 in the fourth embodiment. S1001 to S1012 in FIG. 9 will not be described. In FIG. 14, processing at S1501 to S1505 is the same as S1401 to S1405 in FIG. 12 and therefore will not be described. In FIG. 12 in the third embodiment, the main body control unit 55 calculates the difference Δ between the Mahalanobis' distance $D^2(n-1)$ and the Mahalanobis' distance $D^2(n)$ ($4=D^2(n-1)-D^2(n)$) if the set number n of the set Un stored in the memory unit 64 is not smaller than 2. By contrast, in FIG. 14 in the fourth embodiment, the main body control unit 55 calculates the difference Δ between the Mahalanobis' distance $D^2(n-2)$ and the Mahalanobis' distance $D^2(n)$ ($4=D^2(n-2)-D^2(n)$) if the set number n of the set Un stored in the memory unit 64 is not smaller than 3.

Thus, at S1506, the main body control unit 55 determines whether the set number n of the set Un is not smaller than 3. If it is determined at S1506 that the set number n of the set Un is smaller than 3, the main body control unit 55 advances the process to S1510; otherwise, the main body control unit 55 advances the process to S1507. At S1507, the main body control unit 55 calculates the difference Δ between the Mahalanobis' distance $D^2(n-2)$ and the Mahalanobis' distance $D^2(n)$ ($4=D^2(n-2)-D^2(n)$). Processing at S1508 to S1511 is the same as S1408 to S1411 in FIG. 12 and therefore will not be described.

As described above, according to the fourth embodiment, whether the sheet feeding roller group 20 is new can be determined even if the data in the set Un includes both data acquired before the replacement of the sheet feeding roller group 20 and data acquired after the replacement.

Thus, according to the fourth embodiment, replacement of a component with a new component can automatically be detected.

Fifth Embodiment

In the first to fourth embodiments, detection of replacement of the sheet feeding roller group 20 with a new one has been described. A fifth embodiment will be described regarding notifying the operator of the occurrence of an operation error if the operator erroneously resets the life information for a sheet feeding inlet different from the sheet feeding inlet having the sheet feeding roller group 20 replaced.

<Process of Providing Operation Error Notification>

Figure 15:
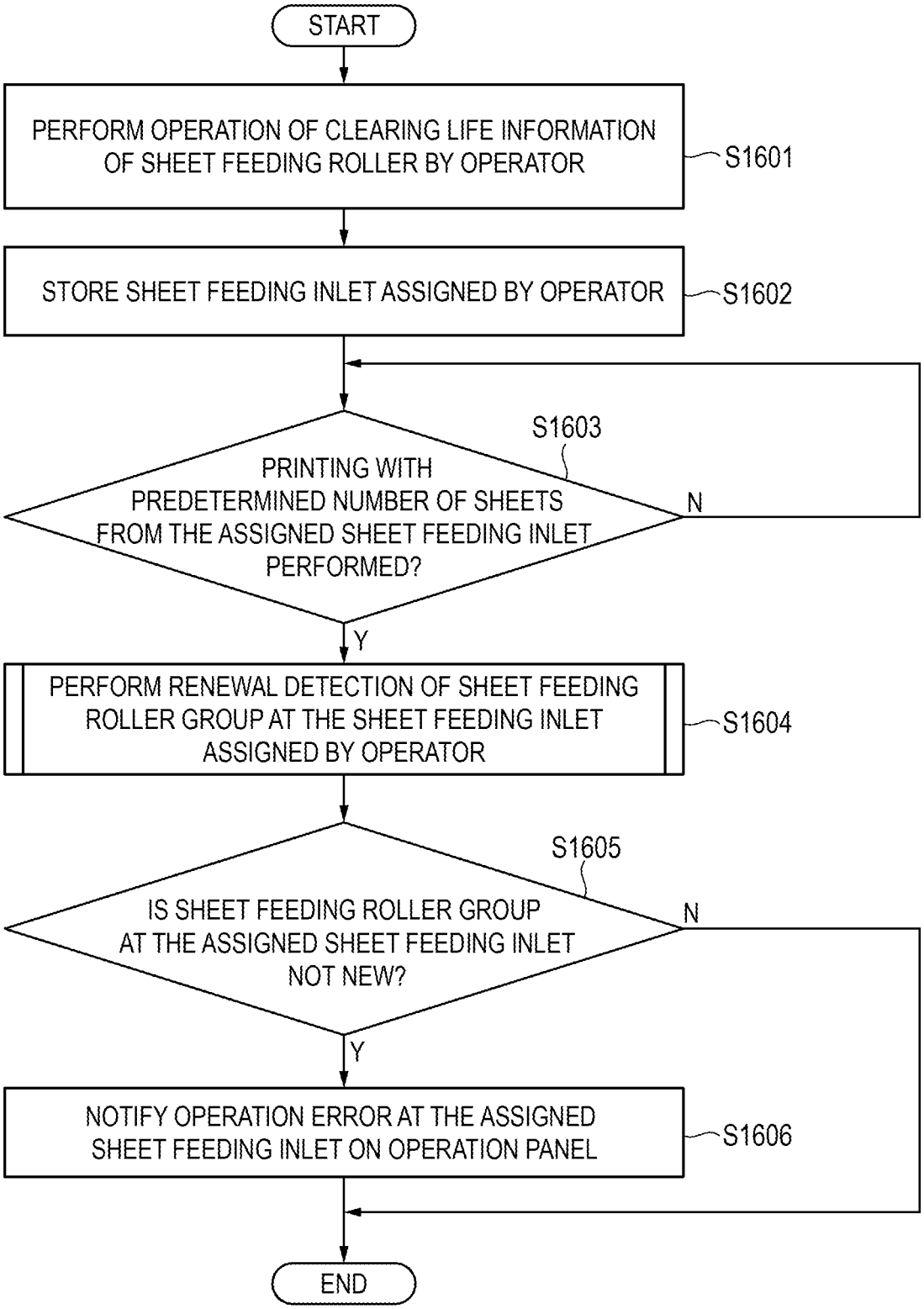
FIG. 15 is a flowchart illustrating the process of detecting an operator's operation error in the fifth embodiment.

FIG. 15 is a flowchart illustrating the process of detecting the operator's operation error in the fifth embodiment. At S1601, the main body control unit 55 detects that the operator performs a resetting operation via, e.g., the operation panel 57 for the life information about the sheet feeding roller group 20. At S1602, the main body control unit 55 stores, in the memory unit 64, information about the sheet feeding inlet designated by the operator via, e.g., the operation panel 57. At S1603, the main body control unit 55 determines whether a predetermined number (for example, Ns=20 in the third embodiment) of sheets have been printed from the sheet feeding inlet designated by the operator. If it is determined at S1603 that the predetermined number of sheets have not been printed, the main body control unit 55 returns the process to S1603; otherwise, the main body control unit 55 advances the process to S1604.

At 51604, the main body control unit 55 performs the renewal detection process for the sheet feeding roller group 20 for the sheet feeding inlet stored in the memory unit 64, i.e., the sheet feeding inlet designated by the operator. The renewal detection process performed at S1604 is the renewal detection process such as in FIGS. 7, 9, 10, 12 and 14 described in the first to fourth embodiments and therefore will not be described. At S1605, according to the result of the renewal detection process at S1604, the main body control unit 55 determines whether the sheet feeding inlet designated by the operator has the sheet feeding roller group 20 that is not new. If it is determined at S1605 that the sheet feeding inlet designated by the operator has the sheet feeding roller group 20 that is not new, the main body control unit 55 advances the process to S1606. At S1606, the main body control unit 55 uses, e.g., the operation panel 57 to provide a notification of the occurrence of an operation error for the sheet feeding inlet designated by the operator. If it is determined at S1605 that the sheet feeding inlet designated by the operator has the sheet feeding roller group 20 that is new, the main body control unit 55 terminates the process because the operator's operation was correct.

As described above, according to the fifth embodiment, a notification of the occurrence of an operation error can be provided if the operator erroneously resets the life information for a sheet feeding inlet different from the sheet feeding inlet having the sheet feeding roller group 20 replaced. Thus, the life state of the inserted sheet feeding roller group 20 can again be correctly detected to prevent future conveyance failures, such as jams and printing failures.

Thus, according to the fifth embodiment, replacement of a component with a new component can automatically be detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-110039, filed Jun. 8, 2018, which is hereby incorporated by reference herein in its entirety.

What is claimed is:

1. An image forming apparatus comprising:

a feeding unit configured to convey a recording material and to be detachably mountable on an apparatus main body that forms an image on the recording material;

a first detection unit configured to detect the recording material, the first detection unit provided downstream of the feeding unit in a conveyance direction of the recording material;

a measurement unit configured to measure a measured time from start of conveyance of the recording material by the feeding unit to detection of the recording material by the detection unit; and a first determination unit configured to form a first data set from a plurality of measured times acquired by the measurement unit in a plurality of measurement processes, form a second data set from a plurality of measured times acquired by the measurement unit in a plurality of measurement processes during a period different from a period during which the first data set is formed, and perform renewal determination for determining whether the feeding unit has been replaced with a new feeding unit based on a change from parameters in the first data set to parameters in the second data set, wherein in a case in which the change is greater than a renewal threshold value N, the first determination unit determines that the feeding unit has been replaced with a new feeding unit, and in a case in which the change is less than the renewal threshold value N, the first determination unit determines that the feeding unit has not been replaced with a new feeding unit.

2. An image forming apparatus according to claim 1, further comprising:

a storage unit configured to store the recording material and to be removable from and insertable into the apparatus main body; and a detection device configured to detect removal and insertion of the storage unit from or into the apparatus main body, wherein the first determination unit defines a plurality of measured times measured by the measurement unit as a data set, during a period from detection of the removal and the insertion of the storage unit to detection of a next removal and insertion of the storage unit.

3. An image forming apparatus according to claim 1, wherein the first determination unit forms the second data set in a case in which at least a predetermined number of sheets of the recording material are fed by the feeding unit after the first data set is formed.

4. An image forming apparatus according to claim 1, wherein the second data set is a data set defined first after the first data set, or is a data set defined second after the first data set.

5. An image forming apparatus according to claim 1, wherein as the parameters characterizing each of the first and second data sets, the first determination unit determines an average of the measured times in the first and second data sets, a maximum of the measured times, or an extent of variations in the measured times.

6. An image forming apparatus according to claim 1, wherein as the parameters characterizing the first and second data sets, the first determination unit determines a plurality of summary statistics from the measured times in each of the first and second data sets and further determines a Mahalanobis' distance from the plurality of summary statistics.

7. An image forming apparatus according to claim 6, wherein the plurality of summary statistics comprises at least one of a 25th percentile, a 75th percentile, an average, a median, a maximum, a minimum, and a standard deviation.

8. An image forming apparatus according to claim 1, further comprising a second determination unit configured to perform end-of-life determination for determining whether it is time to replace the feeding unit based on the measured times measured by the measurement unit, wherein the first determination unit performs the renewal determination after the second determination unit determines that it is time to replace the feeding unit.

9. An image forming apparatus according to claim 1, further comprising an operation unit in which information indicating replacement of the feeding unit with a new feeding unit is input, wherein in a case in which the information is input via the operation unit, the first determination unit performs the renewal determination, and then in a case in which the first determination unit determines that the feeding unit identified in the information is not renewed as a result of the renewal determination, the first determination unit determines to display an operation error occurring in inputting the information via the operation unit.

10. An image forming apparatus according to claim 1, wherein the first determination unit performs the renewal determination for determining whether the feeding unit is replaced with a new feeding unit based on the change and a type of the recording material conveyed by the feeding unit.

11. An image forming apparatus according to claim 10, wherein in a case in which the type of the recording material is plain paper, the first determination unit performs the renewal determination based on the measured times measured by the measurement unit, and in a case in which the type of the recording material is thin paper thinner than the plain paper or is cardboard paper thicker than the plain paper, the determination unit does not perform the renewal determination based on the measured times measured by the measurement unit.

12. An image forming apparatus according to claim 10, further comprising a second detection unit configured to detect the type of the recording material conveyed by the feeding unit.

* * * * *